US012692781B2

(12) United States Patent
Bailey et al.

(10) Patent No.: US 12,692,781 B2
(45) Date of Patent: Jul. 28, 2026

(54) SELF-CONSISTENT FLOW REGIME IDENTIFICATION FOR DOWNHOLE MONITORING

(71) Applicant: Schlumberger Technology Corporation, Sugar Land, TX (US)

(72) Inventors: William J. Bailey, Somerville, MA (US); Terizhandur S. Ramakrishnan, Boxborough, MA (US); Kashif Rashid, Wayland, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 385 days.

(21) Appl. No.: 18/518,002

(22) Filed: Nov. 22, 2023

(65) Prior Publication Data

US 2025/0163800 A1 May 22, 2025

(51) Int. Cl.
*E21B 47/10* (2012.01)

(52) U.S. Cl.
CPC ..... *E21B 47/10* (2013.01)

(58) Field of Classification Search
CPC ..... E21B 2200/20; E21B 47/10
See application file for complete search history.

(56) References Cited

U.S. PATENT DOCUMENTS 6,629,222 B1 * 9/2003 Jeddeloh ..... G11C 7/1093 365/194
6,775,578 B2 8/2004 Couet
8,919,445 B2 12/2014 Fowler
10,352,162 B2 7/2019 Kristensen
11,668,162 B2 6/2023 Lopes Pereira
11,680,464 B2 6/2023 Bailey
11,859,815 B2 1/2024 Al-Shaiji
2002/0029883 A1 3/2002 Vinegar
2008/0133194 A1 6/2008 Klumpen
(Continued)

FOREIGN PATENT DOCUMENTS

EP 4105170 A1 12/2022
WO 2009015346 A1 1/2009
(Continued)

OTHER PUBLICATIONS

Al-Safran, Eissa , Ghasemi, Mohammad , and Feras Al-Ruhaimani. "High-Viscosity Liquid/Gas Flow Pattern Transitions in Upward Vertical Pipe Flow." SPE J. 25 (2020) (Year: 2020).*
(Continued)

*Primary Examiner* — Michael J Dalbo
(74) *Attorney, Agent, or Firm* — Jeffrey D. Frantz

(57) ABSTRACT

Systems and methods of the present disclosure include receiving measured data corresponding to a wellbore and locating the measured data in a flow map corresponding to the wellbore. The method also includes converting the measured data to determine friction loss and comparing the located measured data and the determined friction loss. Moreover, the method also includes determining that the located measured data is consistent with the determined friction loss with a common flow regime and deeming the common flow regime as a current flow regime. Furthermore, the method includes controlling an operation in the wellbore based at least in part on the deemed current flow regime.

12 Claims, 15 Drawing Sheets

(56) References Cited

U.S. PATENT DOCUMENTS

| | | | | |
|---|---|---|---|---|
| 2008/0217019 | A1 | 9/2008 | Walker | |
| 2010/0274546 | A1 | 10/2010 | Zafari | |
| 2012/0160011 | A1* | 6/2012 | Whittaker | G01F 1/00 73/30.03 |
| 2013/0240210 | A1* | 9/2013 | Yale | E21B 21/062 166/305.1 |
| 2017/0220050 | A1* | 8/2017 | Popa | G05B 19/048 |
| 2017/0321548 | A1 | 11/2017 | Enkababian | |
| 2017/0327373 | A1 | 11/2017 | de Graffenried, Sr. | |
| 2018/0004234 | A1* | 1/2018 | Dursun | E21B 43/34 |
| 2019/0120002 | A1 | 4/2019 | Zhang | |
| 2019/0153834 | A1 | 5/2019 | Latimer | |
| 2021/0140299 | A1 | 5/2021 | Dahl | |
| 2022/0316321 | A1 | 10/2022 | Gagliano | |
| 2022/0373176 | A1 | 11/2022 | Al-Shaiji | |
| 2023/0020417 | A1 | 1/2023 | ElBsat | |
| 2023/0272692 | A1 | 8/2023 | Tucker | |
| 2023/0323755 | A1 | 10/2023 | Al-Qasim | |
| 2023/0399938 | A1 | 12/2023 | Hernandez de la Bastida | |
| 2024/0410239 | A1 | 12/2024 | Rashid | |
| 2024/0411951 | A1 | 12/2024 | Rashid | |
| 2025/0067146 | A1 | 2/2025 | Theuveny | |
| 2025/0067147 | A1 | 2/2025 | Theuveny | |
| 2025/0163777 | A1 | 5/2025 | Theuveny | |
| 2025/0264005 | A1 | 8/2025 | Theuveny | |

FOREIGN PATENT DOCUMENTS

| | | | |
|---|---|---|---|
| WO | 2022204718 | A1 | 9/2022 |
| WO | 2023102046 | A1 | 6/2023 |
| WO | 2025174828 | A1 | 8/2025 |

OTHER PUBLICATIONS

Combined Search and Exam Report issued in Great Britain Patent Application No. GB2412383.8 dated Feb. 25, 2025, 6 pages.

International Search Report and Written Opinion issued in the PCT Application No. PCT/US2024/056814 dated Mar. 7, 2025, 10 pages.

International Search Report and Written Opinion issued in the PCT Application No. PCT/US2024/056894 dated Mar. 14, 2025, 14 pages.

Yeo, L. et al., "Optimization of hole cleaning in horizontal and inclined wellbores: A study with computational fluid dynamics", Journal of Petroleum Science and Engineering, 2021, 205, Article 108993, 13 pages.

Osundre, O.S. et al., "Gas-Liquid Flow Regime Maps for Horizontal Pipelines: Predicting Flow Regimes Using Dimensionless Parameter Groups", Multiphase Science and Technology, 2022, 34(4), pp. 75-99.

Amaya-Gomez, R. et al., "Probabilistic approach of a flow pattern map for horizontal, vertical, and inclined pipes", Oil Gas Science and Technology—Rev. IFP Energies nouvelles 74, 2019, Article 67, pp. 1-13.

Bailey, W. J. et al., "Framework for Field Optimization to Maximize Asset Value," SPE-87026-PA, SPE Reservoir Engineering, 2005, 8(1), pp. 7-21.

Bailey, W. J. et al."Forecast Optimization and Value of Information Under Uncertainty", in book: Uncertainty Analysis and Reservoir Modeling, Y.Z. Ma P.R. LaPointe (eds.), AAPG Memoir Series #96, Chapter 14, 27 pages.

Barnea, D. et al., "Holdup of the Liquid Slug in Two-Phase Intermittent Flow," International Journal of Multiphase Flow, 1985, 11(1), pp. 43-49.

Barnea, D. et al., "Void Fraction Measurements in Vertical Slug Flow: Applications to Slug Characteristics and Transition", International Journal of Multiphase Flow, 1989, 15(4), pp. 495-504.

Barnea, D., "A Unified Model for Predicting Flow-Pattern Transitions for the Whole Rangeof Pipe Inclinations," International Journal of Multiphase Flow, 1987, 13(1), pp. 1-12.

Colebrook, C. F. et al., "Experiments with Fluid Friction in Roughened Pipes," Proceedings of the Royal Society Series A: Math. Phys. Sci., London, UK, 1937, 161(906), pp. 367-381.

Colebrook, C.F. "Turbulent Flow in Pipes with particular reference to the Transition Region between Smooth and Rough Pipe Laws," Journal of Institute of Civil Engineering, London, UK, 11, 1938/1939, pp. 133-156.

Dukler, A. E. et al., "A Model for Gas-Liquid Slug Flow in Horizontal and Near Horizontal Tubes," Industrial Engineering Chemistry Fundamentals, 1975, 14(4), pp. 337-347.

Fernandes, R.C. et al., "Hydrodynamic Model for Gas-Liquid Slug Flow in Vertical Tubes," AIChE Journal, 1983, 29(6), pp. 981-989.

Fernandes, R.C, "Experimental and Theoretical Studies of Isothermal Upward Gas-Liquid Flows in Vertical Tubes", PhD thesis, University of Houston, TX, 1981, 21 pages.

Mukherjee, H. et al., "Empirical Equations to Predict Flow Patterns in Two-Phase Inclined Flow," International Journal of Multiphase Flow, 1985, 11(3), pp. 299-315.

Raghuraman, B. et al., "Valuation of Technology and Information for Reservoir Risk Management," SPE-86568, SPE Reservoir Engineering, 2003, 6(5), pp. 307-316.

Rashid, K. et al., "An adaptive multiquadric radial basis function method for expensive black-box mixed-integer nonlinear constrained optimization", Engineering Optimization, 2013, 45(2), pp.

Reynolds, O., "An Experimental Investigation of the Circumstances Which Determine Whether the Motion of Water Shall Be Direct Or Sinuous, and of the Law of Resistance in Parallel Channels", Philosophical Transactions of The Royal Society, 174, 1883, pp. 935-982.

Sylvester, N. D., "A Mechanistic Model for Two-Phase Vertical Slug Flow in Pipes," Journal of Energy Resources Technology, Transactions, ASME, 1987, 109(4), pp. 206-213.

Taitel, Y. et al., "A Consistent Approach for Calculating Pressure Drop in Inclined Slug Flow," Chemical Engineering Science, 1990, 45(5), pp. 1199-1206.

Taitel, Y. et al., "Two-Phase Slug Flow", Advances in Heat Transfer, 1990, 20, pp. 83-132.

Taitel, Y. et al., "A Model for Predicting Flow Regime Transitions in Horizontal and Near Horizontal Gas-Liquid Flow," AIChE Journal, 1976, 22(1), pp. 47-55.

Vo, D. T. et al., "A Note on the Existence of a Solution for Two-Phase Slug Flow in Vertical Pipes," Journal of Energy Resources Technology, Transactions of the ASME, 1989, pp. 64-65 plus Errata published in the same journal in Dec. 1989, p. 213, correcting several errors present in the original.

Yildirim, G. et al., "Computer-based analysis of explicit approximations to the implicit Colebrook-White equation in turbulent flow friction factor calculation," Advances in Engineering Software, 2009, 40(11), pp. 1183-1190.

Office Action issued in U.S. Appl. No. 18/333,342 dated Jun. 17, 2024, 7 pages.

Combined Search and Exam Report issued in United Kingdom Patent Application No. GB2408399.0 dated Oct. 28, 2024, 10 pages.

Office Action issued in U.S. Appl. No. 18/333,342 dated Nov. 13, 2024, 6 pages.

Combined Search and Exam Report issued in United Kingdom Patent Application No. GB2408398.2 dated Nov. 27, 2024, 5 pages.

Combined Search and Exam Report issued in United Kingdom Patent Application No. GB2412311.9 dated Jan. 22, 2025, 6 pages.

* cited by examiner

SELF-CONSISTENT FLOW REGIME IDENTIFICATION FOR DOWNHOLE MONITORING

FIELD OF THE INVENTION

This disclosure relates generally to hydrocarbon production and exploration and, more particularly, to methods and apparatuses to monitor wellbore operations.

BACKGROUND INFORMATION

Wellbores may be drilled into subsurface rocks to create wells to access subterranean fluids, such as hydrocarbons, stored in subterranean formations. When these subterranean fluids are produced from the wells, it may be desirable to obtain certain characteristics of the produced fluids to facilitate efficient and economic exploration and production. For example, it may be desirable to obtain flow rates and/or other characteristics of the produced fluids. These produced fluids are often multiphase fluids (e.g., having some combination of water, oil, and gas).

Production logging is often hindered by an inability to translate hold-up fractions and total flow rate into fractional flow rates of phases. The assumption of fractional flow rates equaling total flow rate multiplied by the hold-up fractions fail to varying degrees of error due to a relative velocity between phases, the magnitude of which may be comparable to the average velocity. This difference depends on the flow regime, orientation with respect to vertical, fluid properties, and/or other characteristics. Thus, such simple multiplications may not be appropriate for various conditions universally.

SUMMARY

A summary of certain embodiments described herein is set forth below. It should be understood that these aspects are presented merely to provide the reader with a brief summary of these certain embodiments and that these aspects are not intended to limit the scope of this disclosure.

In one embodiment, a method includes receiving, at one or more processors, measured data corresponding to a wellbore and locating, using the one or more processors, the measured data in a flow map corresponding to the wellbore. The method also includes converting, using the one or more processors, the measured data to determine friction loss and comparing, using the one or more processors, the located measured data and the determined friction loss. Moreover, the method also includes determining, using the one or more processors, that the located measured data is consistent with the determined friction loss with a common flow regime and deeming, using the one or more processors, the common flow regime as a current flow regime. Furthermore, the method includes using the one or more processors to control an operation in the wellbore based at least in part on the deemed current flow regime.

In another embodiment, a system includes one or more memory devices storing instructions and one or more processors configured to execute the instructions. The instructions, when executed, cause the one or more processors to set a first superficial velocity from multiple first superficial velocities using a first index and to set a second superficial velocity from multiple second superficial velocities using a second index. Moreover, the instructions, when executed, cause the one or more processors to identify a flow regime for the index values based at least in part on the first and second superficial velocities and to increment the second index. Additionally, the instructions, when executed, cause the one or more processors to, until the second index reaches a first maximum value, perform a first loop, the first loop including continuing to set the second superficial velocity based on the second index, identify the flow regime for the index values, and increment the second index. After the second index has met or exceeded the maximum value, the instructions cause the one or more processors to reset the second index and increment the first index. Until the first index reaches a second maximum value, the processor(s) perform a second loop, wherein the second loop comprises iteratively performing operations of the first loop and incrementing the first index. The instructions, when executed, then cause the one or more processors to return multiple indications of flow regimes for the multiple first superficial velocities and the multiple second superficial velocities and set transition boundaries in a flow map to best fit the multiple indications.

In a further embodiment, a system includes one or more memory devices storing instructions and one or more processors configured to execute the instructions to cause the one or more processors to receive measured data corresponding to a wellbore and to locate the measured data in a flow map corresponding to the wellbore to classify a measured flow regime from the measured data using a first classification. The instructions also cause the one or more processors to convert the measured data to determine friction loss and determine a second classification of the measured flow regime from the friction loss. The one or more processors also determine that the first and second classifications are not consistent and adjust a transition boundary in the flow map based at least in part on the determination that the first and second classifications are not consistent. Finally, the instructions cause the one or more processors to control an operation in the wellbore based at least in part on identification of the measured flow regime based on the adjustment of the transition boundary.

BRIEF DESCRIPTION OF THE DRAWINGS

Various aspects of this disclosure may be better understood upon reading the following detailed description and upon reference to the drawings, in which.

DETAILED DESCRIPTION

Figure 1:
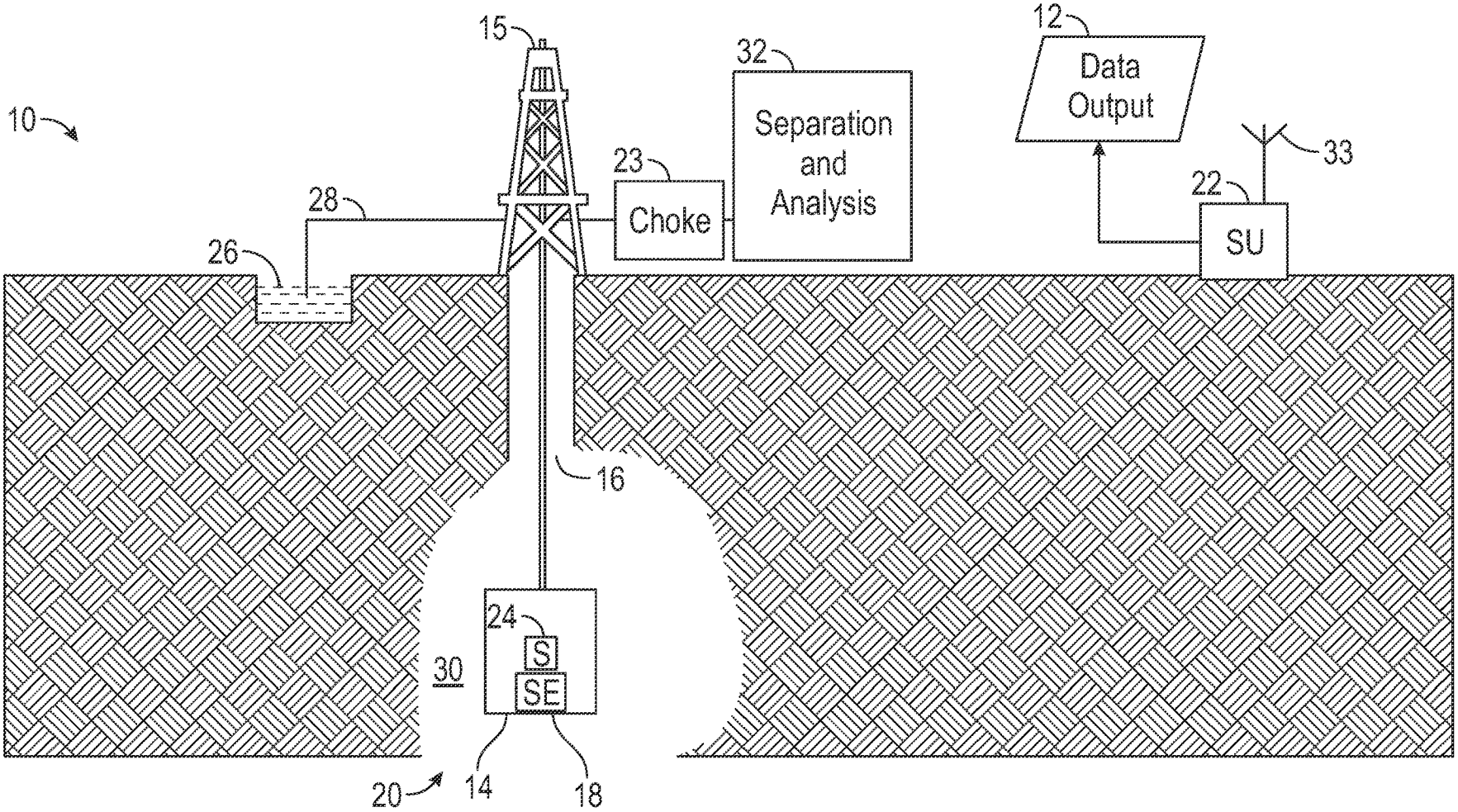
FIG. 1 illustrates a diagram of a data capturing system used to capture data in and/or around an oilfield, such as in a wellbore, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below," "up" and "down," "upper" and "lower," "upwardly" and "downwardly," and other like terms indicating relative positions above or below a given point are used in this description to more clearly describe certain embodiments. Furthermore, "optimize" as used herein is intended to cover scenarios where certain objectives/parameters are enhanced or improved even if there may be further improvement available. In other words, an operation may be optimized without being the most optimized possible solution.

As previously noted, simple multiplications may not be appropriate for various conditions universally. Therefore, a phase map for identifying flow patterns may be deployed to provide improved quantitative production logging. A scheme for regime identification from the measured pressure drop, total flow, and hold-up fractions may be used, so that fractional flows may be computed more accurately.

A self-consistent flow-regime identification workflow is used to identify flow patterns. The workflow may be embedded in a simulator. Downhole pressure, total flowrate, and holdup fraction are included as input data. Each of these values are measurable. Frequency dependent complex electrical impedance may also aid flow regime classification or reinforcement of classification. Although liquid-gas flow is emphasized for discussion herein, these techniques are applicable for flows with three or more phases. Improved insight of in situ multiphase fractional flow with in-flow control valves in extended reach wells may improve production efficiency. For instance, in gas wells that produce water where production cuts are hard to interpret from downhole measurements and surface data is noisy with poor temporal resolution, such techniques can reduce water plugging and promote continuous production.

Drift flux (DF) modeling may be used to simulate wellbore-to-reservoir flow. For instance, drift flux modeling may be like that disclosed in U.S. Pat. No. 11,680,464, entitled "Methods and Systems for Reservoir and Wellbore Simulation" filed Dec. 9, 2019, and that is incorporated by reference herein for all purposes. However, in some embodiments, these simulations with such models may be limited to a range of inclinations from a minimum inclination (e.g., 5 degrees) to vertical. This is true due to pronounced in situ churn and fluctuating co-current and counter-current flows particularly near horizontal. Near horizontal may be defined by scenario and/or choice as within 2, 3, 4, 5, or more degrees of true horizontal. An updated DF model may be used herein that accommodates horizontal or near-horizontal flows.

With the foregoing in mind, FIG. 1 illustrates a data capturing system 10 to capture and produce data output 12 in an oilfield that is captured as part of a clean-up operation, wireline operation, pumping operation, drilling operation, extraction operation, or any other operation being performed. In the illustrated embodiment, the data capture is being at least partially performed by a wireline tool 14 suspended by a rig 15 and into a wellbore 16 during drilling. During production/clean-out, data may be acquired using other tools (e.g., surface measurements). The wireline tool 14 is adapted for deployment into wellbore 16 for generating well logs, performing downhole tests, collecting samples, and/or collecting any other data. For instance, the wireline tool 14 may assist in performing a logging while drilling (LWD) operation. Additionally or alternatively, the wireline tool 14 may, for example, have an explosive, radioactive, electrical, or acoustic energy source 18 that sends and/or receives electrical signals to surrounding subterranean formations 20 and/or fluids therein. Return signals may be detected using the wireline tool 14 and/or other tools located at other locations at/near the oilfield.

Computer facilities may be positioned at various locations about the oilfield (e.g., the surface unit 22) and/or at remote locations. The surface unit 22 may be used to communicate with the wireline tool 14 and/or offsite operations, as well as with other surface or downhole sensors. The surface unit 22 is capable of communicating with the wireline tool 14, pumps, a choke 23, and/or other equipment. For instance, the choke 23 may be an adjustable choke that controls fluid flow out of the wellbore. The surface unit 22 may also collect data generated during the drilling operation, clean-out operation, production operation, and/or logging operation and produces data output 12, which may then be stored or transmitted. In other words, the surface unit 22 may collect data generated during the clean-out operation and may produce data output 12 that may be stored or transmitted.

The surface unit 22 may include one or more various sensors and/or gauges that may additionally or alternatively be located at other locations in the oilfield. These sensors and/or gauges may be positioned about the oilfield (e.g., in/at the rig 15) to collect data relating to various field operations. As shown, at least one downhole sensor 24 is positioned in the wireline tool 14 to measure downhole parameters which relate to, for example porosity, permeability, fluid composition and/or other parameters of the field operation. During drilling, different or more parameters, such as weight on bit, torque on bit, pressures, temperatures, flow rates, compositions, rotary speed, and/or other parameters of the field operation, may be measured.

The surface unit 22 may include a transceiver 33 to enable communications between the surface unit 22 and various portions of the oilfield or other locations. The surface unit 22 may also be provided with or functionally connected to one or more controllers for actuating mechanisms at the oilfield. The surface unit 22 may then send command signals to the oilfield in response to data received. The surface unit 22 may receive commands via the transceiver 33 or may itself execute commands to the controller. A computing system including a processor may be included to analyze the data (locally or remotely), make decisions, control operations, and/or actuate the controller. In this manner, the oilfield may be selectively adjusted based on the data collected. This technique may be used to enhance portions of the field operation, such as controlling drilling, weight on bit, pump rates, and/or other parameters. These adjustments may be made automatically based on an executing application with or without user input.

A mud pit 26 is used to draw drilling mud into the drilling tools via flow line 28 for circulating drilling mud down through the drilling tools, then up wellbore 16 and back to the surface. The drilling mud may be filtered and returned to the mud pit 26. A circulating system may be used for storing, controlling, or filtering the flowing drilling muds. The drilling tools are advanced into subterranean formations 20 to reach a reservoir 30. Each well may target one or more reservoirs.

Generally, the wellbore 16 is drilled according to a drilling plan that is established prior to drilling. The drilling plan sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also be adjusted as additional information is collected.

After the drilling operation is completed, at least some drilling mud and/or other materials other than the desired subterranean fluid may remain in the wellbore. To remove these unwanted materials, a clean-up operation may be performed. As effluent travel upwards through the wellbore 16, it travels through the choke 23. As previously noted, this effluent may be multiphase consisting of multiple fluids (e.g., oil, gas, and water). This multiphase fluid traverses the choke 23 and enters into a separation and analysis system 32. The separation and analysis system 32 may be at least partially included in the surface unit 22. The separation and analysis system 32 may include a horizontal separator, a vertical separator, and/or any other mechanisms that may facilitate separation of the incoming effluent. For instance, the separator may include a 3-phase gravity separator that separates the effluent into its separate gas, oil, and water sub-elements. The analysis portion of the separation and analysis system 32 may evaluate how successful the separation of the sub-elements has been. Additionally or alternatively, the analysis portion of the separation and analysis system 32 may determine flow rates of water and other liquids to determine whether the clean-up has been completed. Additionally, if the effluent contains solids, the analysis portion of the separation and analysis system 32 may determine the value of basic sediments and water (BSW) in the effluent to determine whether the clean-up operation has been completed.

The data gathered by sensors 24 may be collected by the surface unit 22 and/or other data collection sources for analysis or other processing. The data collected by the sensors 24 may be used alone or in combination with other data. The data may be collected in one or more databases and/or transmitted to another location on-site or offsite. The data may be historical data, real time data, or combinations thereof. The real time data may be used in real time or stored for later use. The data may also be combined with historical data and/or other inputs for further analysis. The data may be stored in separate databases and/or combined into a single database.

Figure 2:
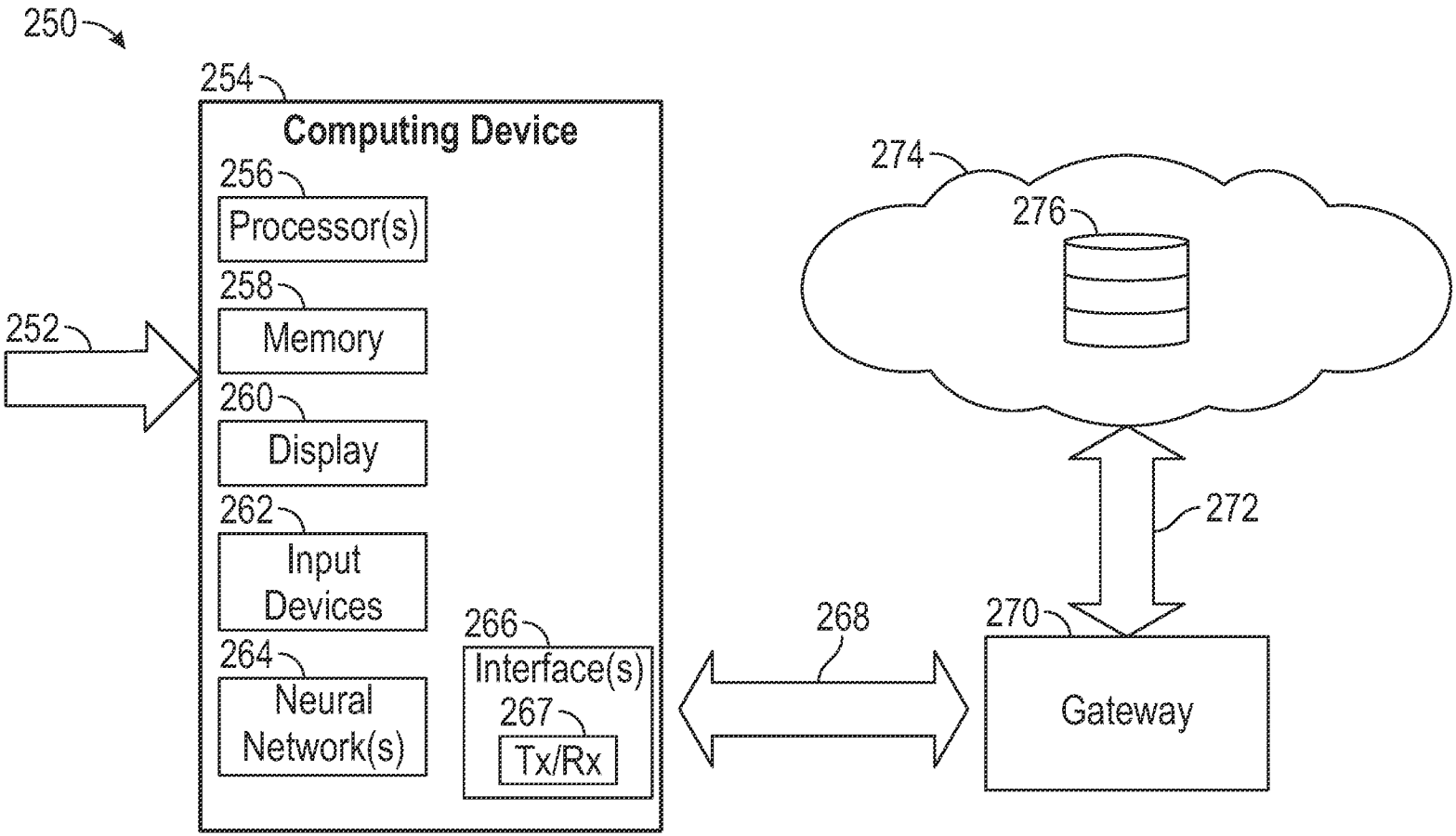
FIG. 2 illustrates a computing system used to process data from the data capturing system of FIG. 1, in accordance with embodiments of the present disclosure.

FIG. 2 is a block diagram of a system 250 that may be used for analyzing/utilizing the data output 12 from the data capturing system 10, as described in FIG. 1. The data output 12, as described in FIG. 1, is received as input data 252 at a computing device 254. The computing device 254 may be implemented in the surface unit 22 and/or may be implemented at other locations within the oilfield or remotely from the oilfield where the remote locations are able to receive the data via the transceiver 33. The various functional blocks shown in FIG. 2 may include hardware elements (including circuitry), software elements (including computer code stored on a tangible computer-readable medium), or a combination of both hardware and software elements. It should be noted that FIG. 2 is merely one example of a particular implementation and is intended to illustrate the types of components that may be present in the computing device 254.

As illustrated, the computing device 254 includes one or more processor(s) 256, a memory 258, a display 260, input devices 262, one or more neural network(s) 264, and one or more interface(s) 266. In the computing device 254, the processor(s) 256 may be operably coupled with the memory 258 to facilitate the use of the processor(s) 256 to implement various stored programs. Such programs or instructions executed by the processor(s) 256 may be stored in any suitable article of manufacture that includes one or more tangible, computer-readable media at least collectively storing the instructions or routines, such as the memory 258. The memory 258 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 256 to enable the computing device 254 to provide various functionalities.

The input devices 262 of the computing device 254 may enable a user to interact with the computing device 254 (e.g., pressing a button to increase or decrease a volume level). The interface(s) 266 may enable the computing device 254 to interface with various other electronic devices. The interface(s) 266 may include, for example, one or more network interfaces for a personal area network (PAN), such as a Bluetooth network, for a local area network (LAN) or wireless local area network (WLAN), such as an IEEE 802.11x Wi-Fi network or an IEEE 802.15.4 wireless network, and/or for a wide area network (WAN), such as a cellular network. The interface(s) 266 may additionally or alternatively include one or more interfaces for, for example, broadband fixed wireless access networks (WiMAX), mobile broadband Wireless networks (mobile WiMAX), and so forth.

In certain embodiments, to enable the computing device 254 to communicate over the aforementioned wireless networks (e.g., Wi-Fi, WiMAX, mobile WiMAX, 4G, LTE, and so forth), the computing device 254 may include a transceiver (Tx/Rx) 267. The transceiver 267 may include any circuitry that may be useful in both wirelessly receiving and wirelessly transmitting signals (e.g., data signals). The transceiver 267 may include a transmitter and a receiver combined into a single unit.

The input devices 262, in combination with the display 260, may allow a user to control the computing device 254. For example, the input devices 262 may be used to control/initiate operation of the neural network(s) 264. Some input devices 262 may include a keyboard and/or mouse, a microphone that may obtain a user's voice for various voice-related features, and/or a speaker that may enable audio playback. The input devices 262 may also include a headphone input that may provide a connection to external speakers and/or headphones.

The neural network(s) 264 may include hardware and/or software logic that may be arranged in one or more network layers. In some embodiments, the neural network(s) 264 may be used to implement machine learning and may include one or more suitable neural network types. For instance, the neural network(s) 264 may include a perceptron, a feed-forward neural network, a multi-layer perceptron, a convolutional neural network, a long short-term memory (LSTM) network, a sequence-to-sequence model, and/or a modular neural network. In some embodiments, the neural network(s) 264 may include at least one deep learning neural network.

The output of the neural network(s) 264 may be based on the input data 252, such as flow rates or other data captured during drilling, clean-out, and/or other operations. This output may be used by the computing device 254. Additionally or alternatively, the output from the neural network(s) 264 may be transmitted using a communication path 268 from the computing device 254 to a gateway 270. The communication path 268 may use any of the communication techniques previously discussed as available via the interface(s) 266. For instance, the interface(s) 266 may connect to the gateway 270 using wired (e.g., Ethernet) or wireless (e.g., IEEE 802.11) connections. The gateway 270 couples the computing device 254 to a wide-area network (WAN) connection 272, such as the Internet. The WAN connection 272 may couple the computing device 254 to a cloud network 274. The cloud network 274 may include one or more computing devices 254 grouped into one or more locations (e.g., data centers). The cloud network 274 includes one or more databases 276 that may be used to store the output of the neural network(s) 264. In some embodiments, the cloud network 274 may perform additional transformations on the data using its own processor(s) 256 and/or neural network(s) 264.

Figure 3:
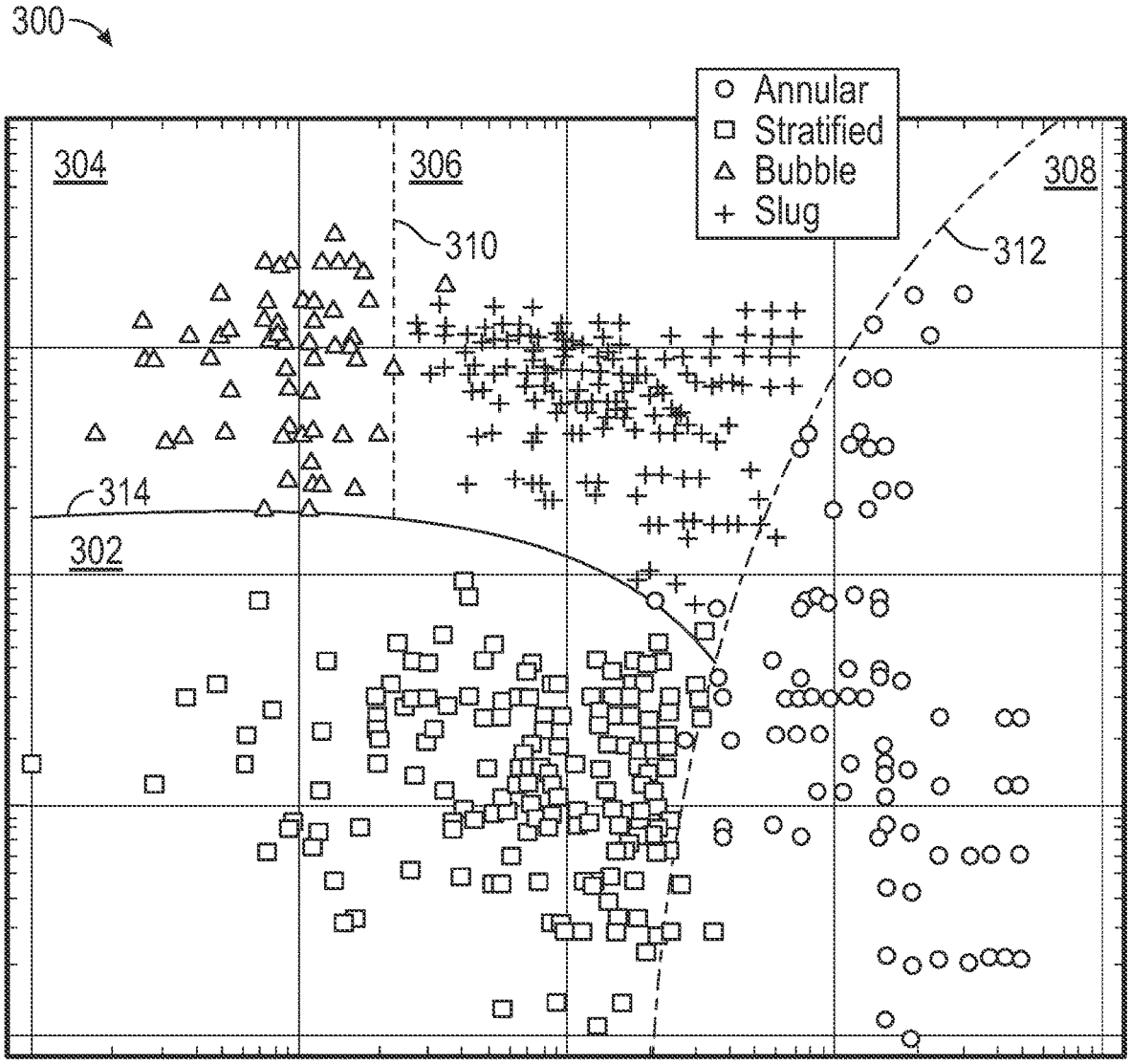
FIG. 3 illustrates a flow map showing multiple data points graphing superficial liquid velocities versus superficial gas velocities, in accordance with embodiments of the present disclosure.

The wellbore 16 may undergo various different flow regimes that may occur in the wellbore 16. The identification of such qualitative flow regimes may indicate how to simulate and/or operate in the wellbore 16, such as adjusting sizes of underground valves and/or surface choke apertures. One method of determining the flow regime may include generating a flow map using real data points. For instance, FIG. 3 shows a flow map 300 showing multiple data points graphing (dimensionless) superficial liquid velocity along the vertical axis and (dimensionless) superficial gas velocity along the horizontal axis. The data points may be assigned to one of multiple flow regimes. As illustrated, the flow regimes may include annular, stratified, bubble, and slug flow regimes. These data points may be assigned such flow regimes based on verified data that is verified using an appropriate verification scheme such as visual confirmation. For example, the annular flow scheme may include a flow that has annular flow with liquid and gas formed into rings (loosely) about some axis of flow through the wellbore 16. The stratified flow regime may include a flow that has stratified layers of liquid and gas, the bubble flow regime may include a flow that is mostly liquid with gas dissipated in the liquid as bubbles, and the slug flow regime includes a flow that includes a big bubble (slug) of gas then liquid and possibly more air. Furthermore, there may be fewer or more flow regimes in some flow maps. The different flow regimes may be treated differently. For instance, flow may be adjusted to avoid slug flows at least near the bottom of the rig/risers that may cause the rig to shake or cause damage to different equipment.

Based on classifications of the data points to flow regimes, boundaries may be located in the flow map 300 to delineate regions 302, 304, 306, and 308. For instance, a transition boundary 310 may separate the region 304 generally corresponding to bubble flow regimes from the region 306 generally corresponding to slug flow regimes. Similarly, a transition boundary 312 may separate the region 308 generally corresponding to annular flow regimes from the region 306 generally corresponding to slug flow regimes and the region 302 generally corresponding to stratified flow regimes. Similarly, the transition boundary 314 may separate the region 302 generally corresponding to stratified flow regimes from the region 304 generally corresponding to bubble flow regions and the region 306 generally corresponding to slug flow regimes.

A limitation of the flow map 300 is that each point does not specify void fraction. To include such information, one would interrogate the database itself to extract such information. Furthermore, if the flow map were to cover a range of inclinations, the angle pertaining to each data point may also be lost. This information may be useful especially due to the difficulty in multi-phase flow where some assignments of data points of flow regimes may be at least partially true for multiple flow regimes. One mechanism to confirm validity of such classifications may include 'locating' measured pressure drop and determining whether it has been designated with the most appropriate flow regime as located in the flow map 300. For each or at least some of the data points, a computing device (e.g., computing device 254) constructs a probability density function of regime-specific generated dimensionless characteristic unit friction loss. For instance, a dimensionless pressure drop due to friction $N_{Pf}$ is calculated using Equation 1, below:

$$N_{Pf} = \frac{D}{(\rho_m)_{ns} g H_w}\left(\frac{\Delta P_f}{\Delta L}\right)_r, \qquad \text{(Equation 1)}$$

where D is the diameter of the pipe of the wellbore 16, $H_w$ is the true vertical depth (TVD) of the well, while $(\rho_m)_{ns}$ is the no-slip mixture density of the (static) fluid column that may be obtained from surface flow rates or independent hold-up measurements. $\Delta P_f$ is the pressure drop due to friction (i.e., devoid of any gravity head contribution and in uniform diameter pipes). Subscript r represents a flow regime for the friction drop term. The context of L, length over which the pressure drop is defined, may depend on the flow regime. For instance, in some embodiments, this length may be the length over which the pressure drop is measured except for steady-state slug flow where this length may be that of the slug unit (addition of liquid and gas slugs together) itself. g is the acceleration of gravity. In some embodiments, the dimensionless pressure drop due to friction may be averaged together among multiple (e.g., 2, 4, 8, 16, or more) models.

In steady-state multiphase flow, superficial velocities, usually at surface, but occasionally in situ velocities may be known. Along with (known) fluid properties and geometries, one may use a selected multiphase flow model to compute the likely flow regime (e.g., based on dimensional superficial velocities) then use an in-situ void fraction and pressure drop. The nature of the friction drop function is typically specific to each flow regime (hydrostatic head is trivial as it only requires void fraction and phase densities). The complexity lies in the friction loss, $\Delta P_f$. There is a plethora of $\Delta P_f$ models. For instance, a modified Reynolds number based on void-fraction-adjusted fluid properties and mixture velocity $u_m$, assuming a representative pipe roughness, E, the desired friction factor, f, is from a standard Moody chart and inserted into the relevant friction model defined by the selected multiphase flow model.

Computing a probability density function (PDF) of dimensionless unit friction losses may be relatively complex due to identifying a suitable ensemble of friction loss models (for any assigned flow regime) and assigning weights to each model in the ensemble. The ensemble of models assumes an associated steady-state pressure loss function. Constructing PDFs of the dimensionless unit friction loss may be performed using a direct computation where friction loss for each model in the ensemble is performed with weights based on prior knowledge of model sustainability. Alternatively, all of the models may be deemed equally probable. The resulting PDF may be a set of discrete points that are to be bounded by some function.

In addition to or alternative to direct computation for each model, a Fanning friction factor may be computed for all models in the ensemble and may be computed along with their moments from which the PDFs may be generated. The first moment defines $\langle N_{Pf}\rangle_r$ that is the mean of dimensionless unit friction loss for regime r. This approach may assume a predefined form of the PDF (e.g., normal).

Figure 4:
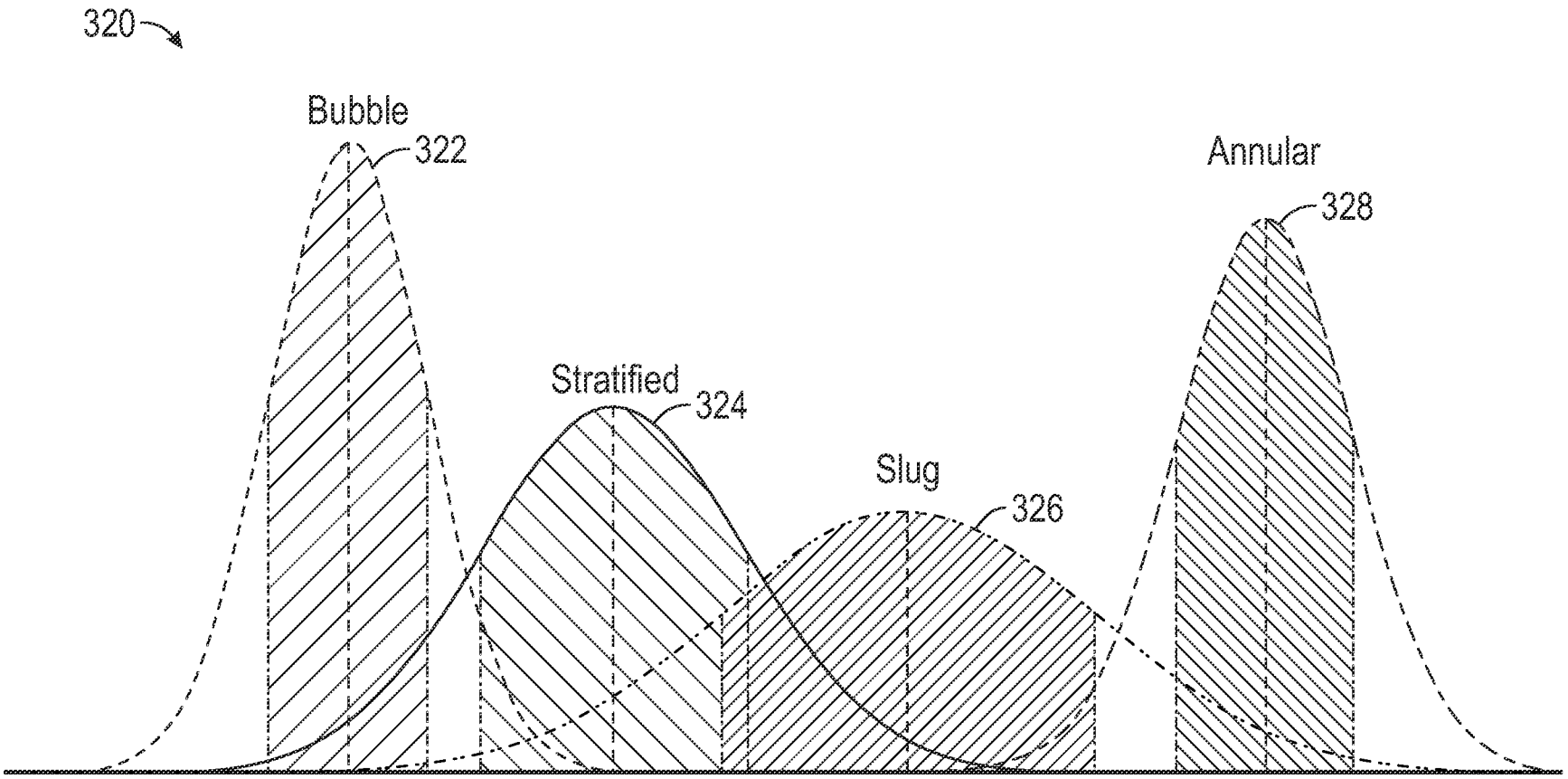
FIG. 4 illustrates a probability density function using unit friction loss parameters for different flow regimes, in accordance with embodiments of the present disclosure.

FIG. 4 is a graphical representation of an embodiment of a PDF 320 of an ensemble-based dimensionless unit friction loss for different flow regimes ($\langle N_{Pf}\rangle_r$). As illustrated, the PDF 320 includes curves 322, 324, 326, and 328 for respective flow regimes: bubble, stratified, slug, and annular flow regimes. The representative PDF 320 reflects possible (Gaussian) distributions for each flow regime from FIG. 3. The shaded/hatched regions may represent plus or minus one standard deviation ($\pm\sigma$) for each respective regime.

Figure 5:
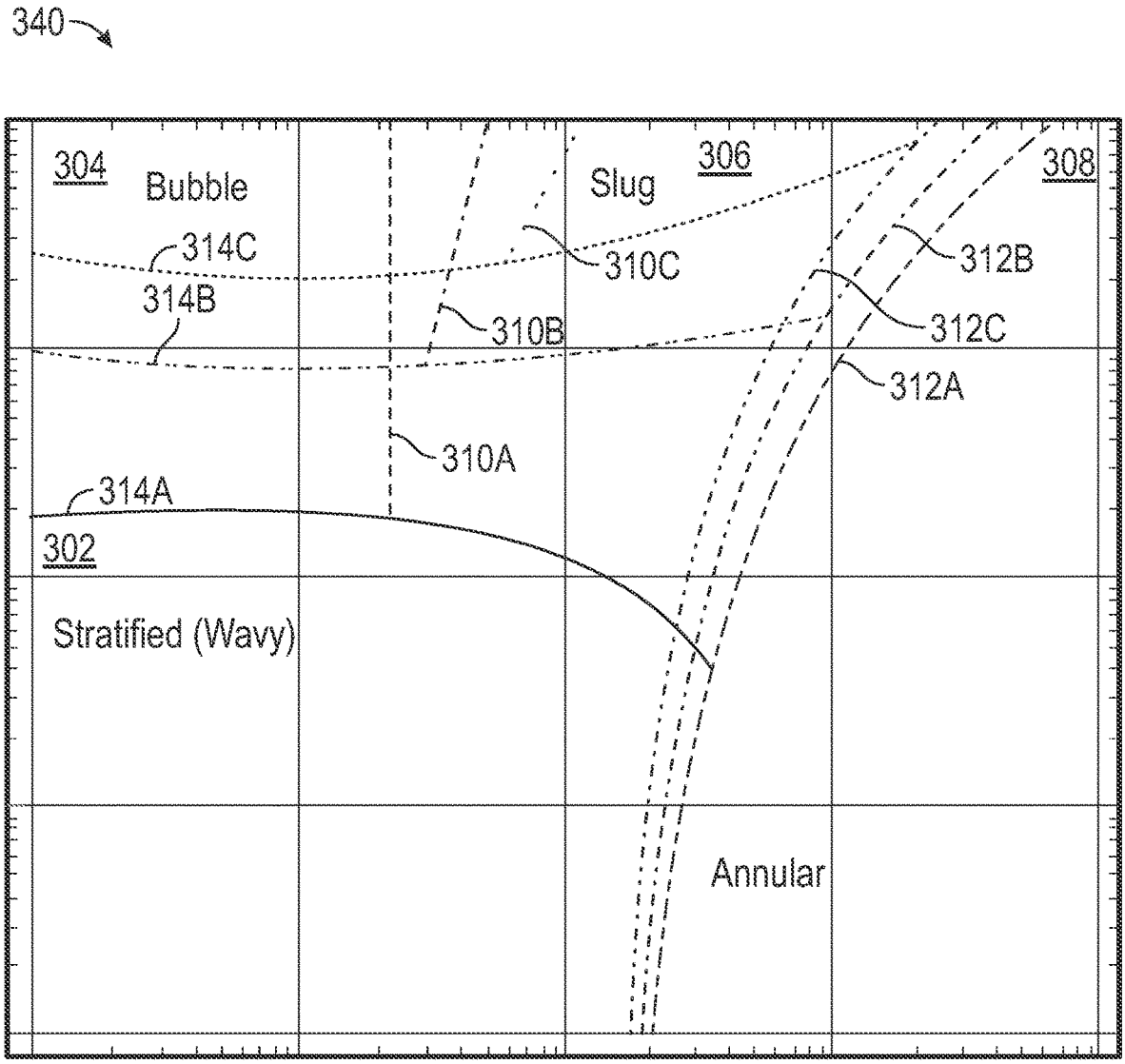
FIG. 5 illustrates a flow map graphing superficial liquid velocities versus superficial gas velocities with different transition boundaries for different angles of inclination, in accordance with embodiments of the present disclosure.

For simplicity, the flow map 300 corresponds to a single inclination (e.g., $\theta=0°$). However, transition boundaries may differ for different inclinations. FIG. 5 is a flow map 340 that shows transition boundaries 310, 312, and 314 for different inclinations. For instance, a transition boundary 310A may correspond to the transition boundary 310 for a first inclination (e.g., $\theta=0°$), a transition boundary 310B may correspond to the transition boundary 310 for a second inclination (e.g., $\theta=25°$), and a transition boundary 310C may correspond to the transition boundary 310 for a third inclination (e.g., $\theta=50°$). Similarly, a transition boundary 312A may correspond to the transition boundary 312 for the first inclination, a transition boundary 312B may correspond to the transition boundary 312 for the second inclination, and a transition boundary 312C may correspond to the transition boundary 312 for the third inclination. Likewise, a transition boundary 314A may correspond to the transition boundary 314 for the first inclination, a transition boundary 314B may correspond to the transition boundary 314 for the second inclination, and a transition boundary 314C may correspond to the transition boundary 314 for the third inclination.

Single Measurement Analysis

Figure 6:
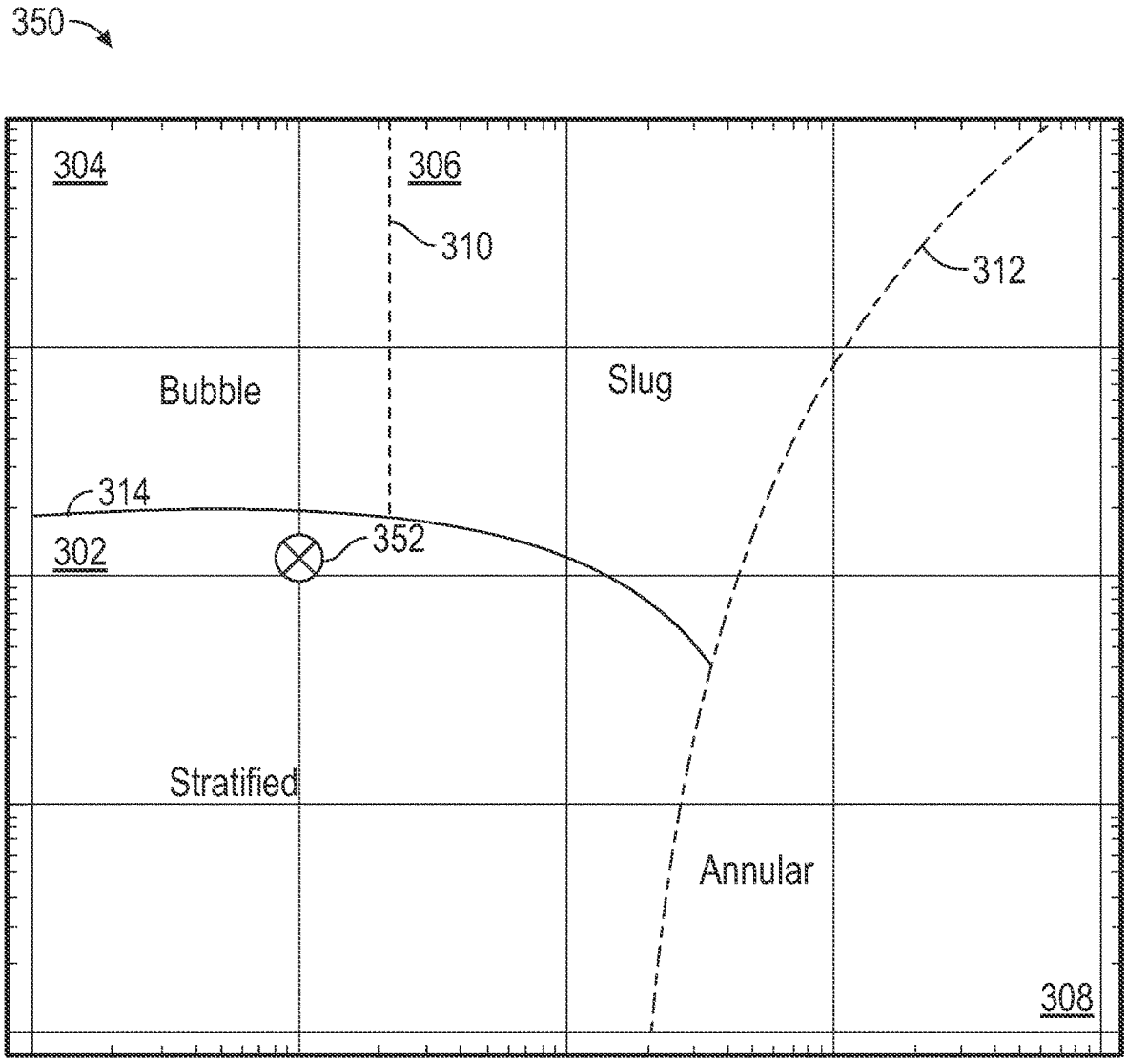
FIG. 6 illustrates a flow map graphing superficial liquid velocities versus superficial gas velocities with measured data plotted thereon, in accordance with embodiments of the present disclosure.
Figure 7:
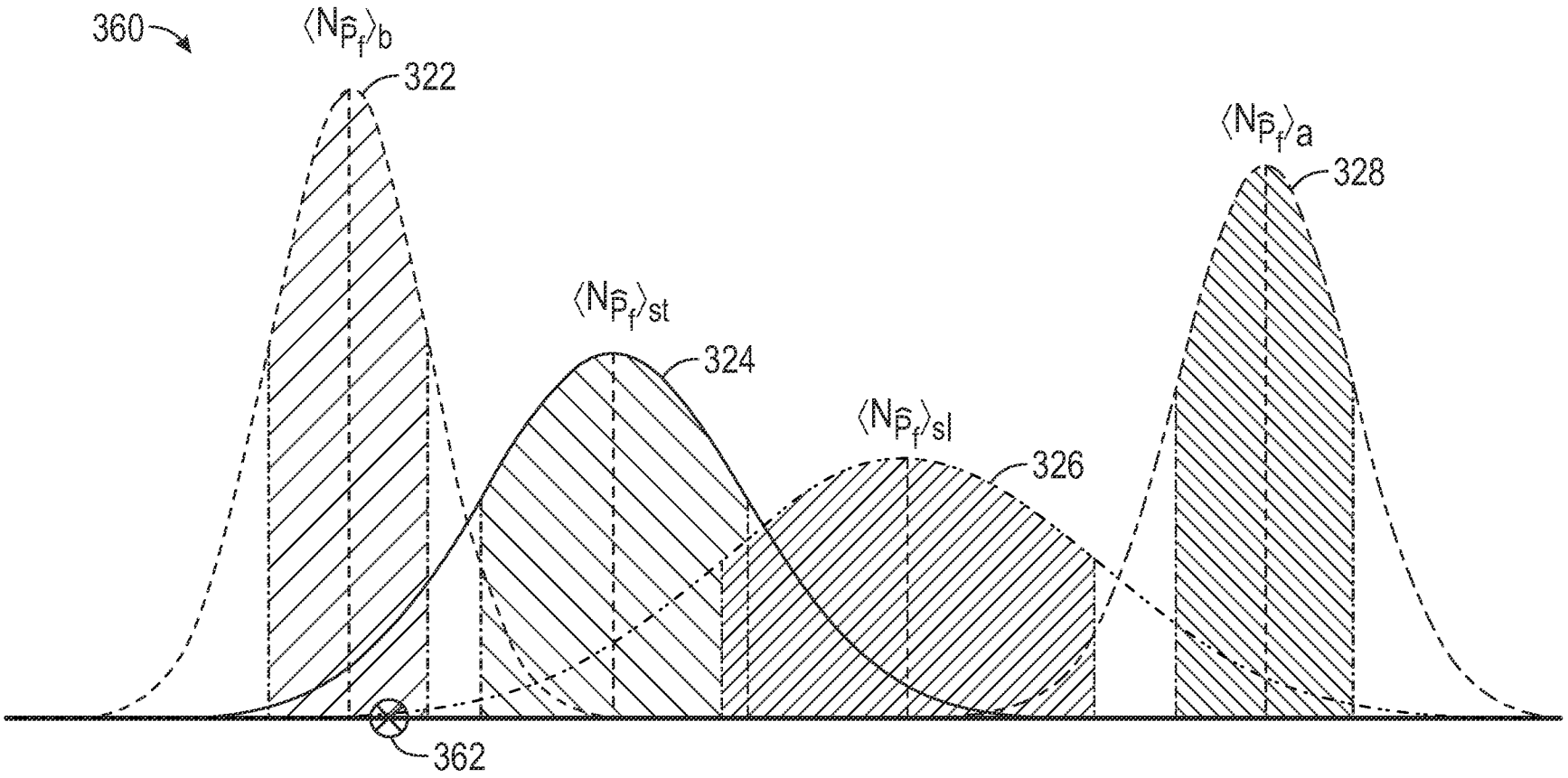
FIG. 7 illustrates a probability density function using unit friction loss parameters for different flow regimes with the measured data of FIG. 6 plotted thereon, in accordance with embodiments of the present disclosure.
Figure 8:
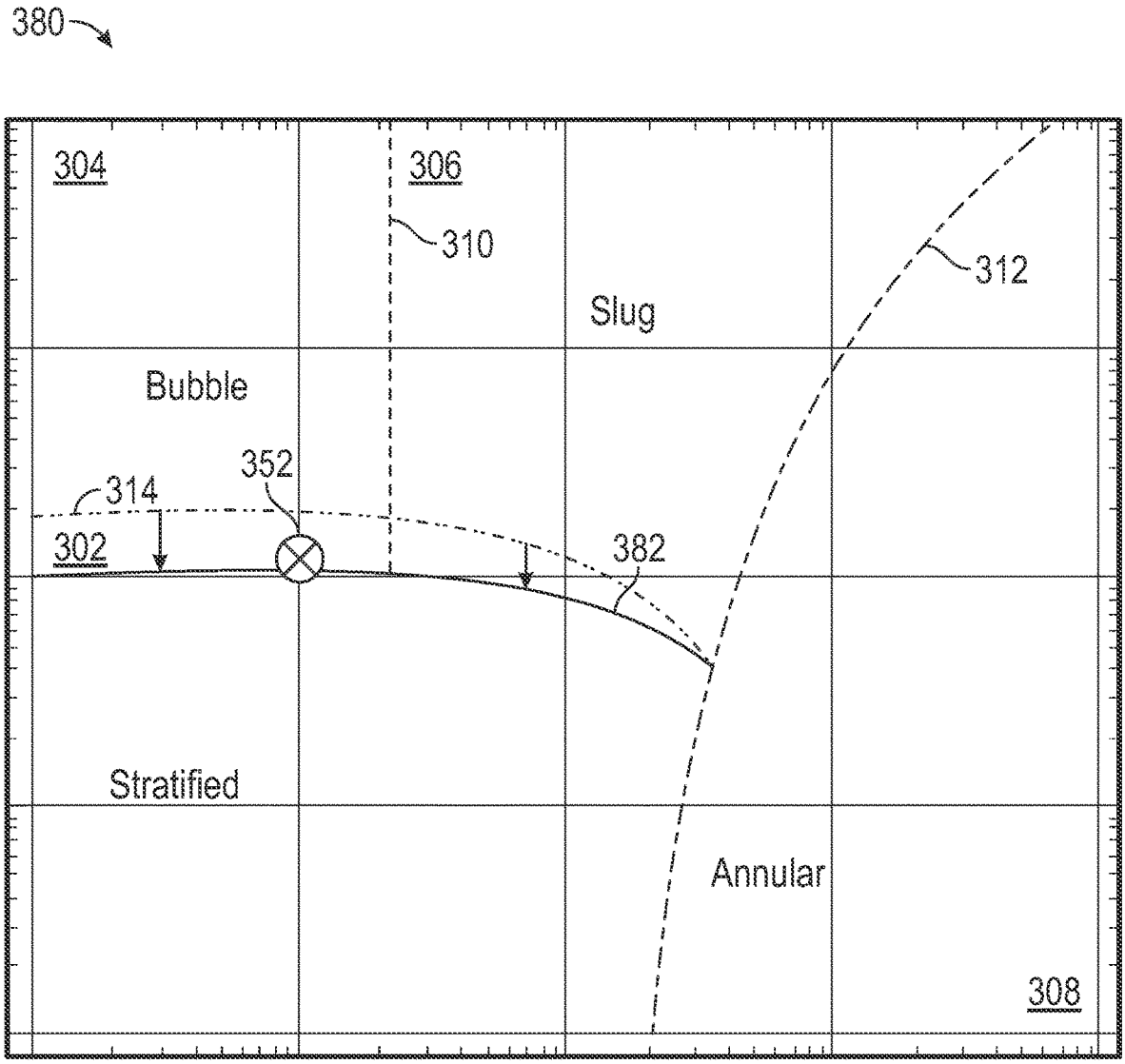
FIG. 8 illustrates the flow map of FIG. 6 after a transition boundary has been adjusted, in accordance with embodiments of the present disclosure.

As illustrated in a flow map 350 of FIG. 6, measured data 352 may be located in dimensionless form on the flow map 350. The flow map 350 may be the same as the flow map 300 except that the measured data 352 is plotted within the region 302 corresponding to the stratified regime. Locating the measured data 352 in the flow map 350 may include using drift-flux modeling since superficial velocities of the flow map may be indirectly determined rather than directly measured. The measured data 352 may be converted into its dimensionless characteristic form of friction loss $N_{Pf}$. For instance, point 362 may be located along an axis of PDF 360 of FIG. 7. The PDF 360 may be same as the PDF 320 except that the point 362 is plotted on the PDF 360. As illustrated in the flow map 350, the measured data 352 is deemed as in the stratified regime. However, in the PDF 360, the point 362 is more strongly correlated to the bubble regime even though the point 362 is under the curve 324 corresponding to the stratified regime. However, the point 362 is close to the mean of the curve 322 while it is over one standard deviation away from the mean of the curve 324. Thus, the point 362 is more strongly associated with the bubble regime than the stratified regime. Accordingly, the flow map 350 may be updated to reclassify the measured data 352 from the region 302 to the region 304 by moving the transition boundary 314 of the flow map 350. FIG. 8 shows a flow map 380 that is the same as the flow map 350 except that the transition boundary 314 has been moved downward 382 to cause the measured data 352 to fall in the region 304 to make the classification of the measured data 352 and the point 362 self-consistent/deterministic. The adjustment of the transition boundary 314 may be performed by visually/graphically moving the transition boundary 314 until the measured data 352 falls within the region 304. This adjustment may be performed using graphical analysis by the computing device 254 and/or using user input. Additionally or alternatively to the graphical adjustment, transition parameters may be adjusted through optimization discussed below.

Figure 9:
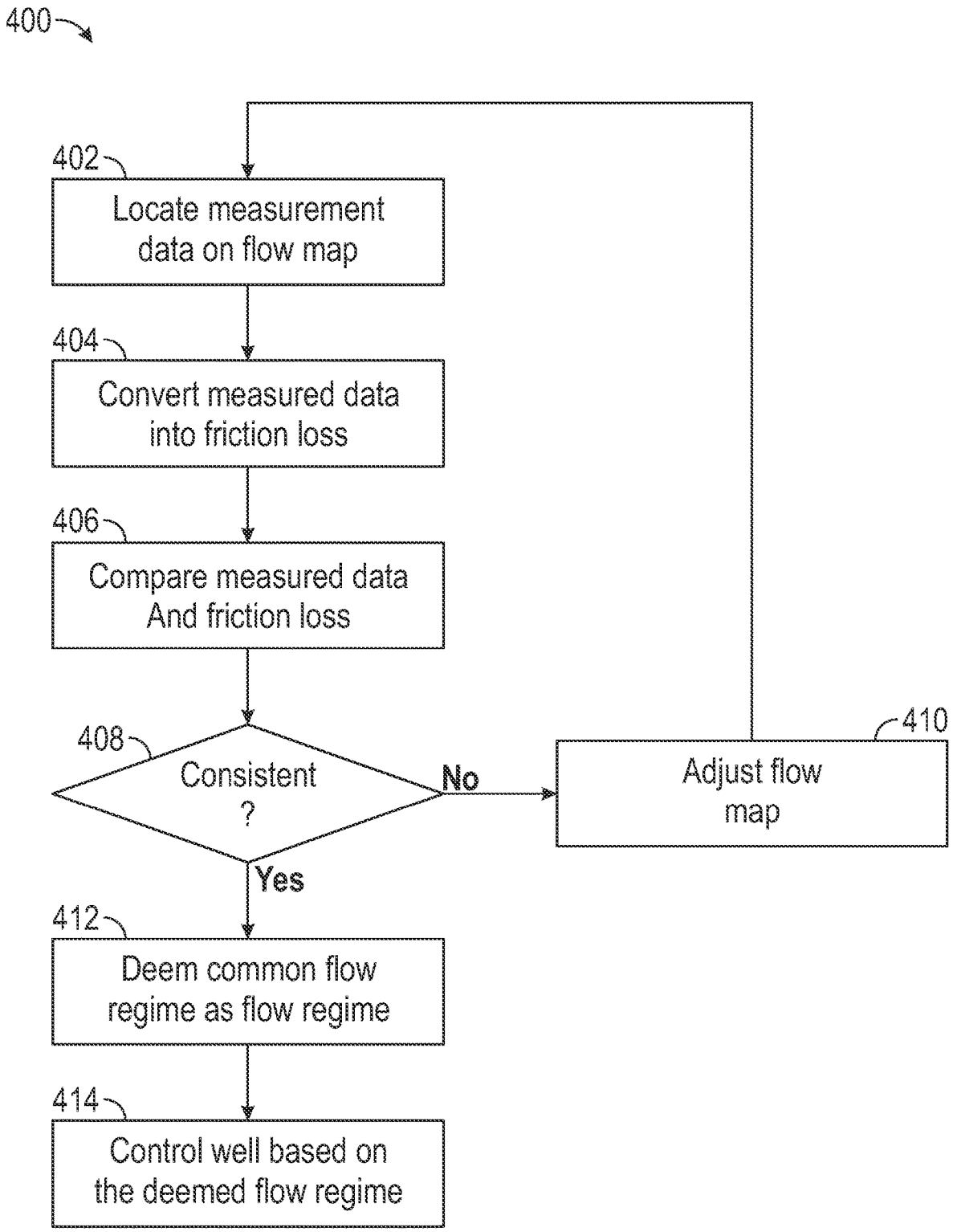
FIG. 9 illustrates a process for using self-consistent flow regime identification to control operations in the wellbore of FIG. 1, in accordance with embodiments of the present disclosure.

FIG. 9 illustrates a process 400 for self-consistent regime classification and usage that may be performed using the one or more processors 256 of one or more computing devices 256. The process 400 includes the computing device 254 locating measurement data on a flow map (block 402). For instance, the computing device 254 may locate the measured data 352 in the flow map 350. Locating this measured data may include selecting the flow map from multiple flow maps based on received user input and/or using parameter matching. Additionally or alternatively, locating the measured data may include receiving the measured data from downhole and/or surface metering to provide volumetric flow rates of each phase. If only surface metering is available, these quantities may be measured and then back allocated to each production zone downhole. Surface meters may also provide phase densities and viscosities. This data and/or modeling may be used to determine the superficial velocities of gas and liquid phases.

The computing device 254 also converts the measured data into friction loss (block 404). For instance, this computation may be made using Equation 1 above. The computing device 254 then compares the location of the measured data on the flow map and a corresponding point in friction loss (e.g., PDF 360) (block 406). Specifically, the computing device 254 determines whether the classification of the point in the PDF 360 and the flow map 350 are consistent (block 408). If they are not consistently classified, the computing device 254 may move one or more transition boundaries in the flow map 350, 380 (block 410). The flow map is changed as the flow map may be based on experimental observations at pressures and/or temperatures that may be different (e.g., significantly lower) than those in the wellbore 16. Thus, the empirical-based flow maps are reasonable to adjust/revise to make consistency of data.

If the classification of the point in the PDF and the measured data in the flow map are consistent, that common flow regime classification (e.g., bubble regime) between the flow map and the PDF may be deemed as the correct flow regime (block 412). Based at least in part on the identification of the flow regime, the computing device 254 may control well operations (block 414). For instance, the computing device 254 may control underground valves and/or aperture sizes of a surface choke based on the identified flow regime. Additionally or alternatively, any other suitable parameters may be adjusted such as pump modes and/or speeds, pressures, and/or other parameters may be changed based at least in part on the identified flow regime.

Optimization-based Flow Map Transition Boundary Adjustment

As previously noted, the boundary transitions may be adjusted using optimization using any suitable model by tuning appropriate tunable parameters. For the purposes of discussion, let p and q represent indices for $$N^s_{g,v}$$

(dimensionless gas phase flow map axis based on the superficial gas velocity) and $$N^s_{L,v}$$

(dimensionless liquid phase flow map axis based on the superficial liquid velocity), respectively. Also, $B_t$ will represent the number of flow map transition curves or functions. For instance, $B_t$ may be 3 for the flow map 380 in FIG. 8. Sc may represent the set of parameters used to define a particular curve. c may be the transition between two flow regime, for instance, Sb-s may indicate a transition between bubble flow and slug flow regimes. For some boundaries, c may be a complement delineation that merely indicates a boundary indicating where the regime is a certain flow regime (e.g., stratified) on one side of the boundary and another flow regime on the other side of the boundary. A maximum set of all parameters, St, may also be defined. Using the foregoing definitions, a summary of regime transitions may be defined as set forth below in Table 1:

TABLE 1

Example regime transitions

| Transition | Index | Expression | Parameters |
|---|---|---|---|
| Bubble-to-Slug | $B_t^1$ | Equation 2 | $S_{b-s} = 5$ |
| Slug-to-Annular | $B_t^2$ | Equation 5 | $S_{s-a} = 4$ |
| Stratified | $B_t^3$ | Equation 7 | $S_{str} = 6$ |
| Slug flow | — $B_t = 3$ | none | none $S_t = 15$ |

$$[N^s_{L,v}]_{b-sl} = 10^B, \quad \text{(Equation 2)}$$

where B is dependent on well inclination. For example, for upwards flow, $$B = B_1 + \left[\log_{10} N^s_{g,v}\right] + \left[B_2 \sin\theta\right] - \left[B_3 \sin^2\theta\right] + \left[B_4 N^s_{L,\mu}\right] + \quad \text{(Equation 3)}$$

$$(B_5 = 0).$$

For downwards or horizontal flow, $$B = B_1 + \left[B_2 \sin\theta\right] - \left[B_3 N^S_{L,\mu}\right] - \left[B_4 (\log_{10} N^s_{L,v}) \sin\theta\right] - \left[B_5 (\log_{10} N^s_{L,v})^2 \sin\theta\right]. \quad \text{(Equation 4)}$$

$$\left[N^s_{g,v}\right]_{s-a} = 10^A, \quad \text{(Equation 5)}$$

$$A = A_1 - (A_2 N_{L,\mu}) + \left[A_3 (N^s_{L,v})^{A_4}\right], \quad \text{(Equation 6)}$$

where $N_{L,\mu}$ is the viscosity number of the liquid.

$$\left[N^s_{g,v}\right]_{strat} = 10^S. \quad \text{(Equation 7)}$$

For horizontal and downward flows, $$S = S_1 + \left[S_2 N^s_{g,v}\right] - \left[S_3 \sin\theta\right] - \left[S_4 N_{L,\mu}\right] - \left[S_5 (\log_{10} N^s_{g,v})^2\right] - \left[S_6 \sin^2\theta\right]. \quad \text{(Equation 8)}$$

The values for various A, S, and B parameters may be determined using empirical testing, modeling, or a combination thereof. Additionally, R may represent the distinct flow regimes defined for the flow map with an $R_{max}$ as the maximum number of flow regimes. For instance, the flow map 380 may have an $R_{max}$ of four.

Figure 10:
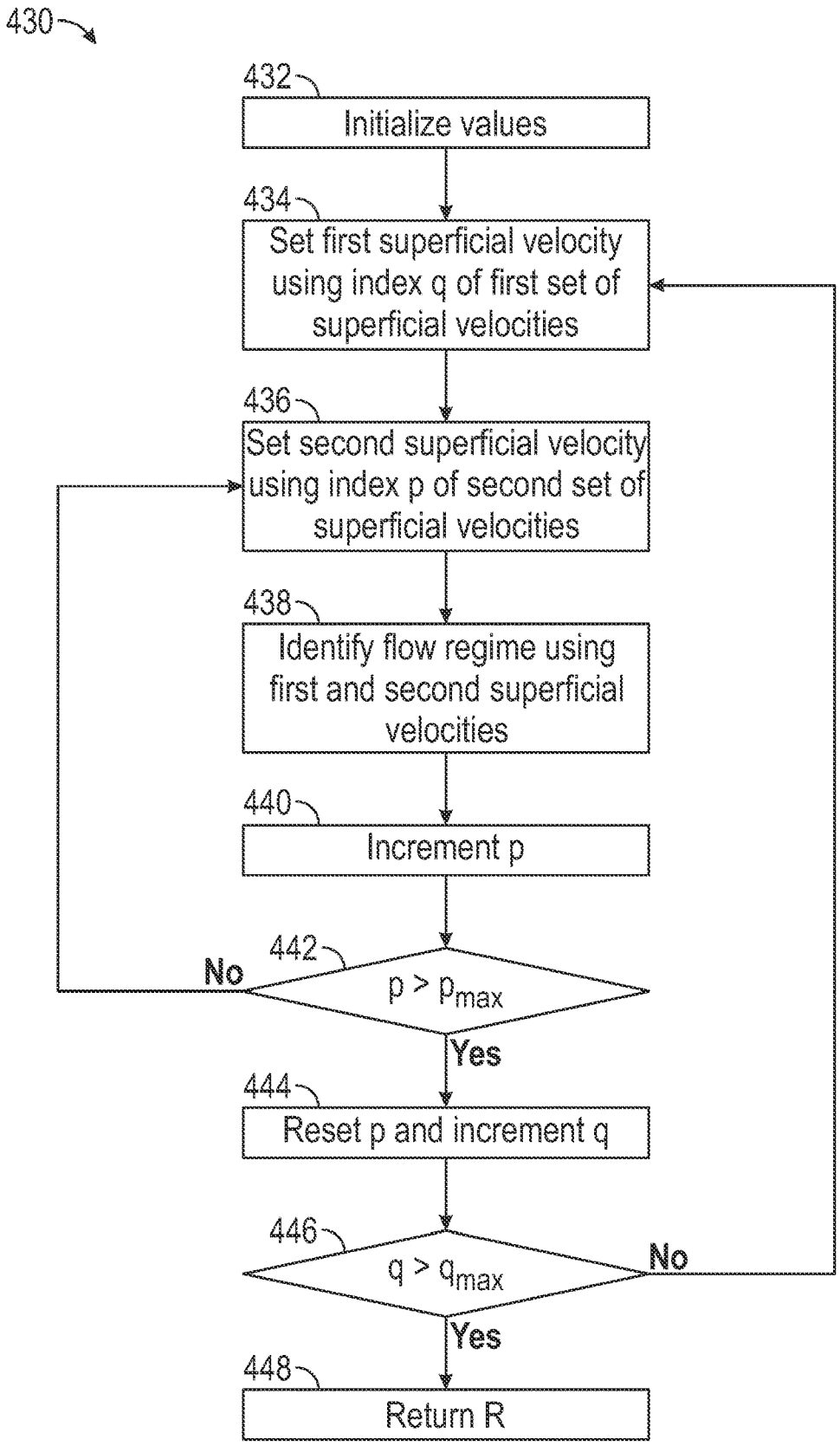
FIG. 10 illustrates a process for performing optimization-based transition boundary adjustments using an identification algorithm, in accordance with embodiments of the present disclosure.

FIG. 10 is a flow diagram of a process 430 for performing optimization-based transition boundary adjustment. This process may be a flow map model, but alternative flow map models may be used with similar techniques. The process 430 begins with the computing device 254 initializing values (block 432). For example, the indices p and q may be initialized to 1, while $R_{max}$ is set to a value (e.g., 4) and R is set to a respective value (e.g., 0) indicating that the respective flow regime (e.g., stratified) is not present while another value (e.g., 1) indicates that the respective flow regime is present in the measured data. A first superficial velocity is set using the index q to pull from a first set of superficial velocities (block 434). The first set of superficial values may be a set of superficial liquid velocities. A second superficial velocity is set using the index p to pull from a second set of superficial velocities (block 436). The second set of superficial values may be a set of superficial gas velocities. The computing device 254 then identifies a flow regime using the first and second superficial velocities (block 438). For instance, the computing device 254 may use any suitable identification algorithm, such as the regime classification process 460 of FIG. 11 and/or using Mukherjee & Brill or Barnea classification algorithms. After classifying the flow regime, the computing device 254 increments p (block 440) and determines whether p is greater than a maximum value for p (block 442). In other words, if there are more first superficial velocities to be analyzed with p being less than or equal to $p_{max}$, the computing device 254 returns to block 436. If all of the first velocities have been analyzed from the first set of superficial velocities, the computing device resets p (e.g., set p=1) and increments q (block 444). The computing device 254 then determines whether q is greater than a maximum value for q (block 446). In other words, if there are more second superficial velocities to be analyzed with q being less than or equal to $q_{max}$, the computing device 254 returns to block 434. Once all samples have been analyzed, R includes indications (e.g., values of 1) for all flow regimes that were encountered during analysis and is returned (block 448). The returned values R may be used to set bounds of the curves to best fit the multiple plot points to ensure that an optimum number of correct classifications is satisfied in the flow map. In some embodiments, some flow regimes may be prioritized to be more correct than others such that if a placement of a transition boundary will cause some points to fall outside of their classified flow regimes, one regime (e.g., slug) may be prioritized for being more correct than at least one other (e.g., stratified).

Figure 11:
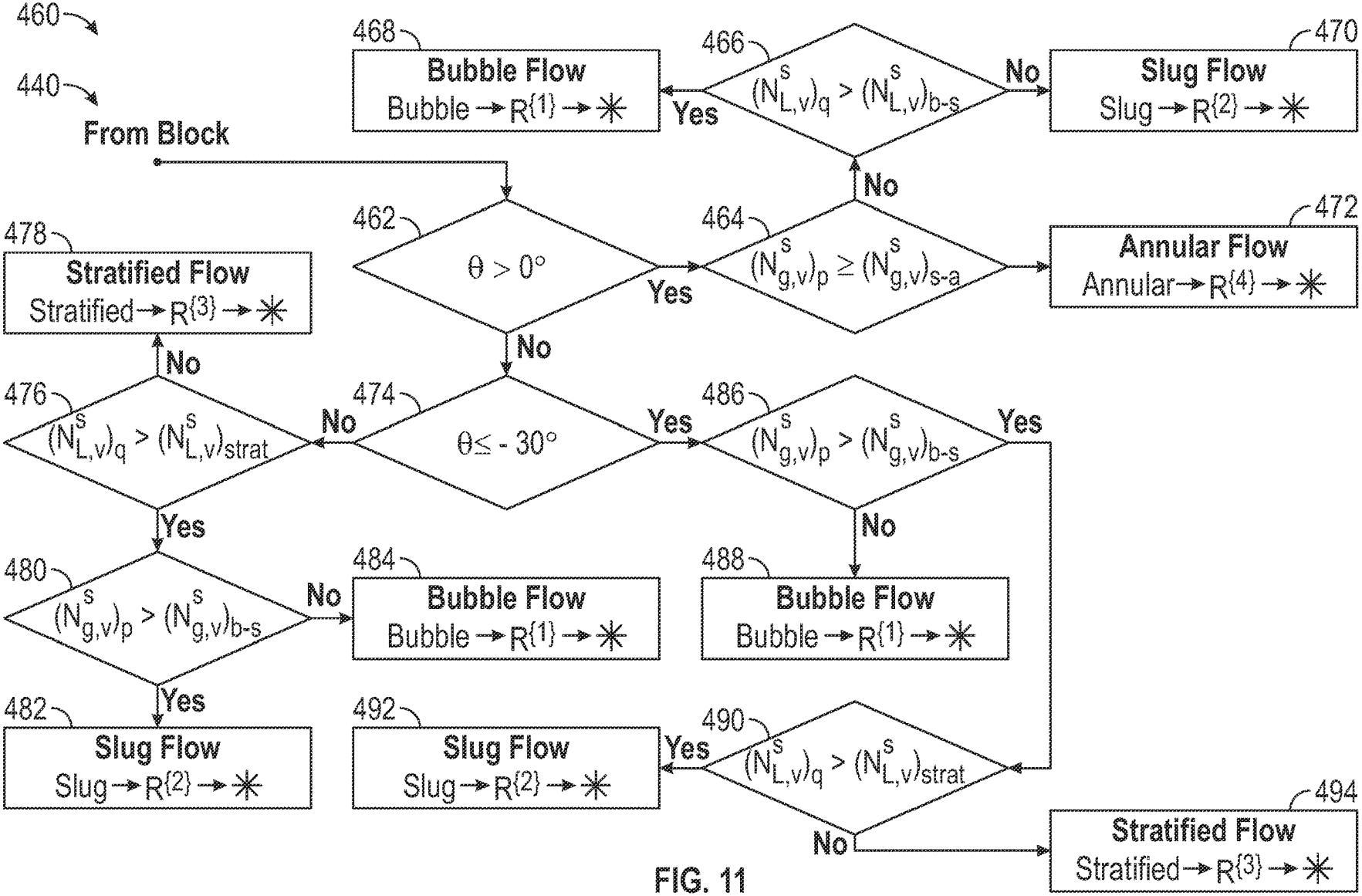
FIG. 11 illustrates an example process for the identification algorithm of FIG. 9, in accordance with embodiments of the present disclosure.

FIG. 11 is a flow diagram of a regime classification process 460 that may be used in the block 440 of the process 430 of FIG. 10. The computing device 254 employs the regime classification process 460 using the first superficial velocity indexed using q (e.g., $$N^s_{L,v}$$

and using the second superficial velocity indexed using p (e.g., (e.g., $$(N^s_{g,v})_p).$$

If the angle of inclination is greater than 0 (block 462), the computing device 254 determines whether $$(N^s_{g,v})_p$$

is greater than or equal to $$(N^s_{g,v})_{s-a}$$

determined from Table 1 (block 464). If $$(N^s_{g,v})_p$$

is not greater than or equal to $$(N^s_{g,v})_{s-a},$$

the computing device 254 determines whether $$(N^s_{L,v})_q$$

is greater than $$(N^s_{L,v})_{b\text{-}s}$$

computed using Table 1 (block 466). If $$(N^s_{L,v})_q$$

is greater than $$(N^s_{L,v})_{b-s},$$

the computing device 254 indicates that the flow regime is bubble flow and returns to process 430 as indicated by the * (block 468). If $$(N^s_{L,v})_q$$

not greater than $$(N^s_{L,v})_{b-s},$$

the computing device 254 indicates that the flow regime is slug flow and returns to process 430 (block 470).

Returning to block 464, if $$(N^s_{g,v})_p$$

is not greater than or equal to $$(N^s_{g,v})_{s-a},$$

the computing device 254 indicates that the flow regime is annular flow and returns to process 430 (block 472). Returning to block 462, if the inclination angle is not greater than 0, the computing device 254 may determine whether the inclination angle is less than or equal to −30° (block 474). If the inclination angle is not less than or equal to −30°, the computing device 254 determines whether $$(N^s_{L,v})_q$$

is greater than $$(N^s_{L,v})_{strat}$$

computed as indicated in Table 1 (block 476). If $$(N^s_{L,v})_q$$

is not greater than $$(N^s_{L,v})_{strat},$$

the computing device 254 indicates that the flow regime is stratified flow and returns to process 430 (block 478). If $$(N^s_{L,v})_q$$

is greater than $$(N^s_{L,v})_{strat},$$

the computing device 254 determines whether $$(N^s_{g,v})_p$$

is greater than $$(N^s_{g,v})_{b-s}$$

(block 480). If $$(N^s_{g,v})_p$$

is greater than $$(N^s_{g,v})_{b-s},$$

the computing device 254 indicates that the flow regime is slug flow (block 482). If $$(N^s_{g,v})_p$$

is not greater than $$(N^s_{g,v})_{b-s},$$

the computing device 254 indicates that the flow regime is bubble flow (block 484).

Returning to block 474, if the inclination angle is not less than or equal to −30° (block 474), the computing device 254 determines whether $$(N^s_{g,v})_p$$

is greater than $$(N^s_{g,v})_{b-s}$$

(block 486). If $$(N^s_{g,v})_p$$

is not greater than $$(N^s_{g,v})_{b-s},$$

the computing device 254 indicates that the flow regime is bubble flow (block 488). If $$(N^s_{g,v})_p$$

is greater than $$(N^s_{g,v})_{b-s},$$

the computing device 254 determines whether $$(N^s_{L,v})_q$$

is greater than $$(N^s_{L,v})_{strat}$$

(block 490). If $$(N^s_{L,v})_q$$

is greater than $$(N^s_{L,v})_{strat},$$

the computing device 254 indicates that the flow regime is slug flow (block 492). If $$(N^s_{L,v})_q$$

is not greater than $$(N^s_{L,v})_{strat},$$

the computing device 254 indicates that the flow regime is stratified flow (block 494).

Figure 12:
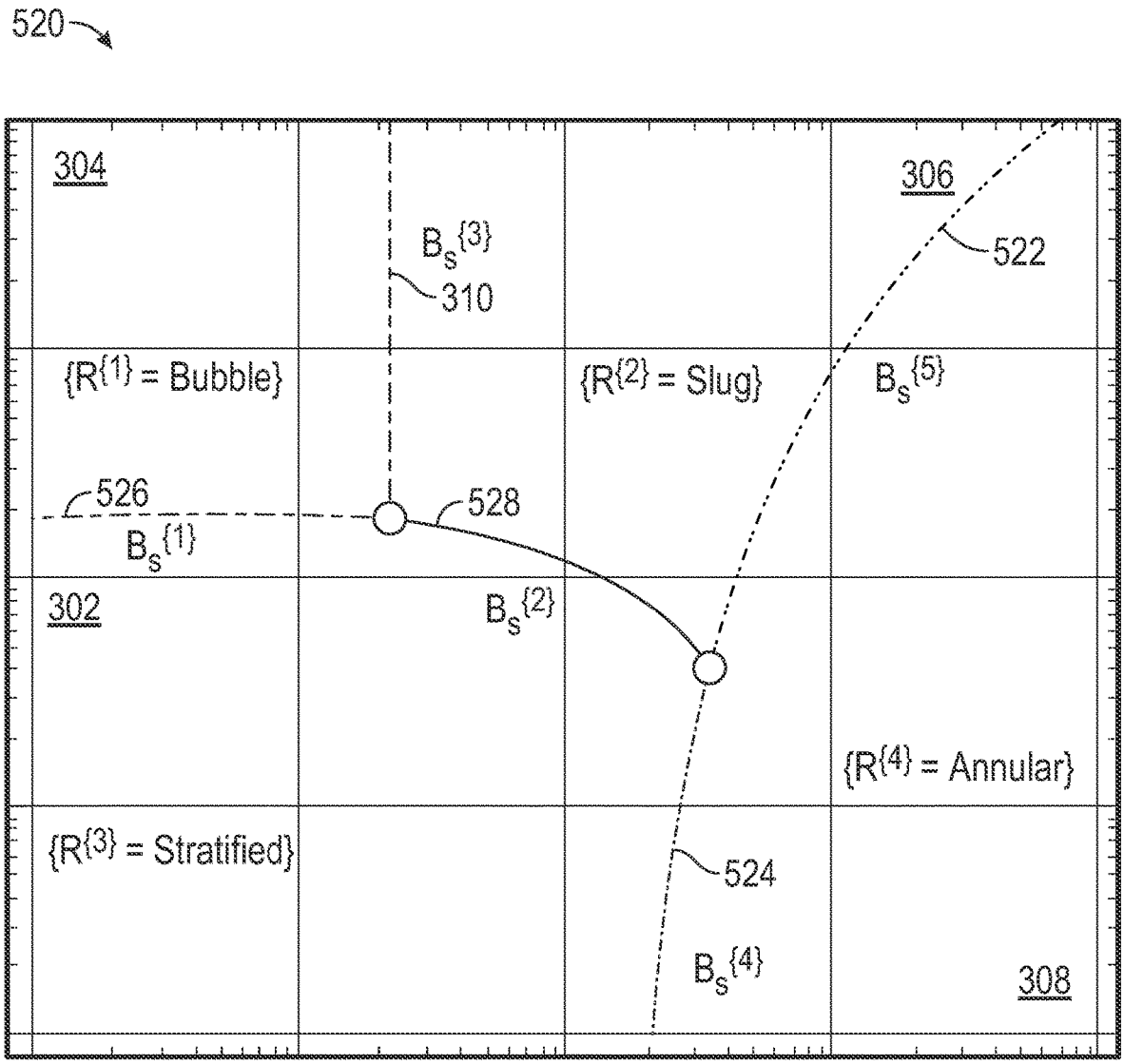
FIG. 12 illustrates a flow map graphing superficial liquid velocities versus superficial gas velocities with segmented transition boundaries, in accordance with embodiments of the present disclosure.

In some embodiments, at least some of the transition boundaries of the flow maps may be segmented into different segments that may be adjusted separately. For instance, FIG. 12 is a graphical representation of a flow map 520 that is similar to the flow map 350 of FIG. 6 except that the transition boundary 312 is segmented into segments 522 and 524 and the transition boundary 314 is segmented into segments 526 and 528.

Multiple Measurement Analysis

Figure 13:
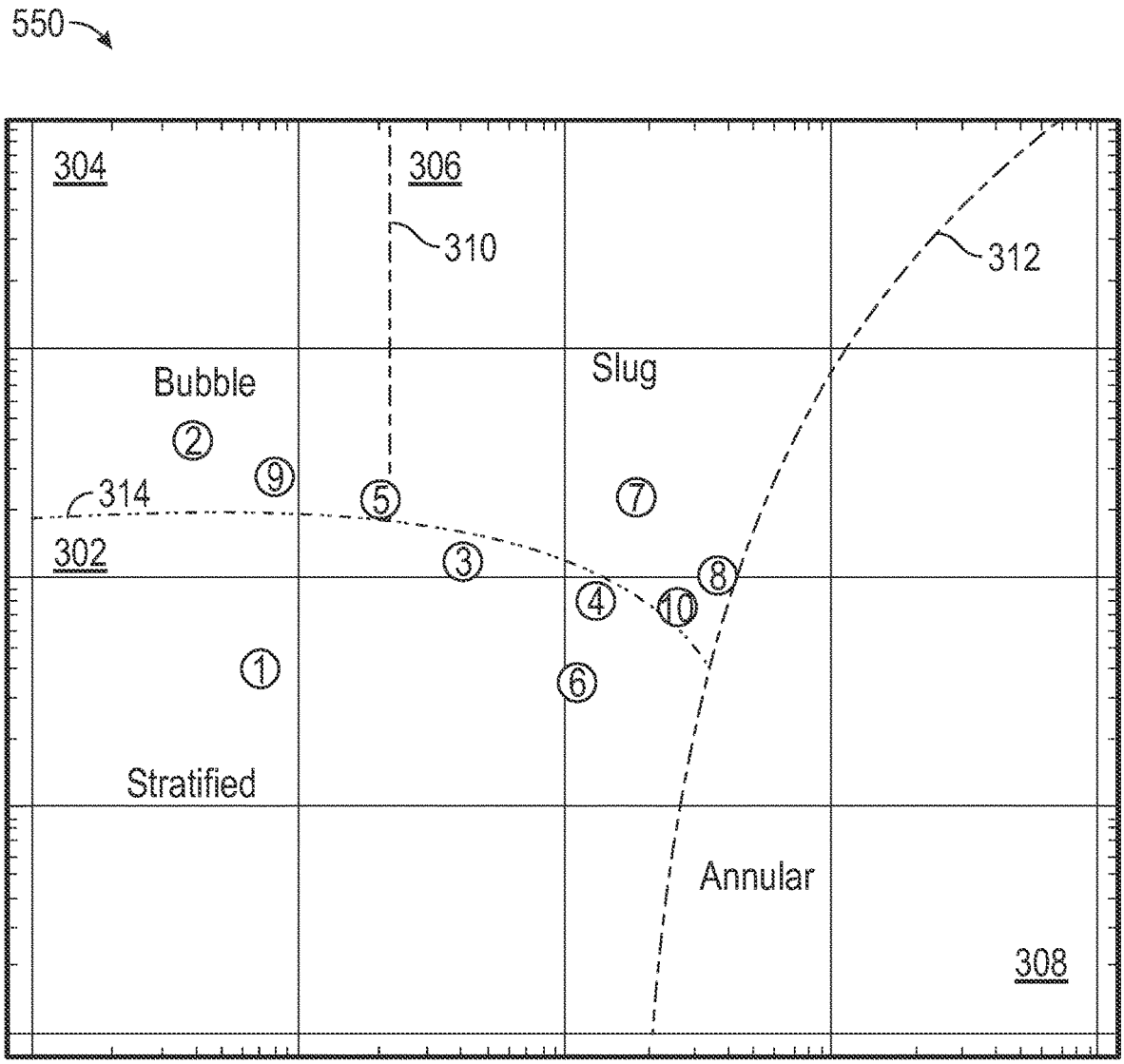
FIG. 13 illustrates a flow map showing multiple data points graphing superficial liquid velocities versus superficial gas velocities, in accordance with embodiments of the present disclosure.

As previously discussed, a single measurement may be located within a flow map and compared to PDFs to determine if the classification is consistent via both the flow map and the PDF. However, often multiple measurements of pressure drops and liquid/gas rates along the wellbore are taken. In such situations, optimization may be applied to minimize the misfit between each measured data and its respective location of the revised flow map. FIG. 13 is a graphical representation of a flow map 550 that is similar to the flow map 350 except that it has 10 data points plotted on the flow map 550. As illustrated, points 2, 5, and 9 are in the region 304 corresponding to bubble flow and would correspondingly be classified as in the bubble flow regime. Similarly, points 1, 3, 4, and 6 are in the region 302 corresponding to stratified flow and would correspondingly be classified as in the stratified flow regime. Likewise, points 7, 8, and 10 are in the region 306 corresponding to slug flow and would correspondingly be classified as in the slug flow regime. As previously noted, the flow map 550 may have relatively sharp transitions defined by the transition boundaries 310, 312, and 314 when actual transitions between flow regimes may be blurry or variable with potential bifurcations driven by stability criteria. Furthermore, observed regimes may be reported from manual observation that may be subject to a wide range of terminologies/definitions and/or subjective interpretations.

Figure 14:
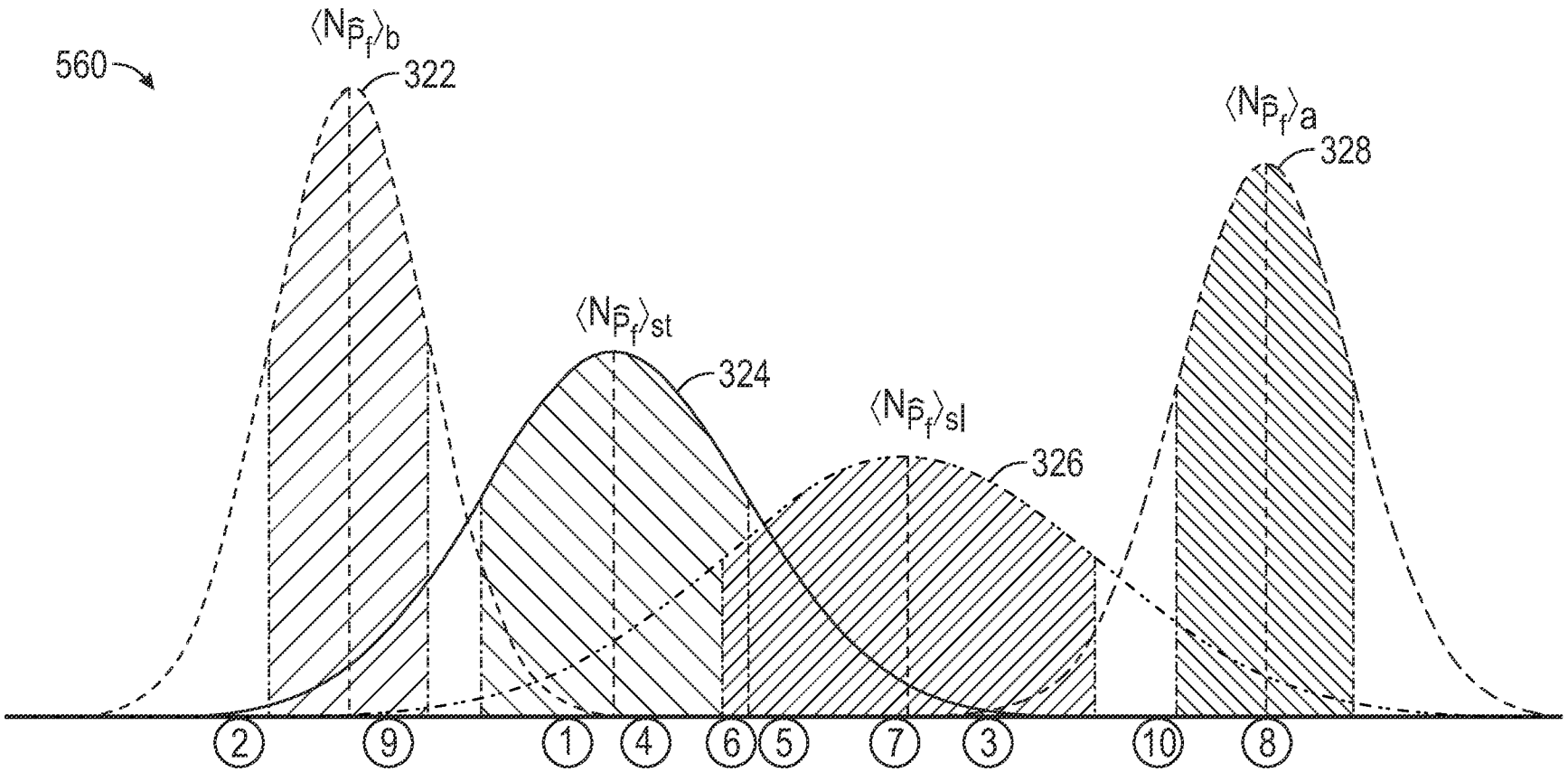
FIG. 14 illustrates a graphical representation of a probability density function using friction loss for different flow regimes and having the multiple data points of FIG. 13 plotted thereon, in accordance with embodiments of the present disclosure.

As previously noted, one way to accommodate these blurry transitions may include assigning a PDF to the transition with the computed line representing the mean about which a distribution (e.g., Gaussian curve) exists and is plotted by a (ensemble-based) dimensionless friction loss $N_{\widehat{pf}}$. FIG. 14 shows a graphical representation of a PDF 560 with the 10 data points plotted on the PDF 560. As illustrated, points 1, 2, 4, 7, 9, and 10 are classified the same from the flow map 550 as they most strongly correspond to in the PDF 560. However, points 3, 5, 6, and 8 may be inconsistent between the two schemes. For instance, point 3 may be best classified as stratified flow in the flow map 550 but may be best classified as slug flow in the PDF 560. Similarly, point 5 may be best classified as unclear/bubble/slug flow from the flow map 550 but may be best classified as slug flow from the PDF 560. Likewise, point 6 may be best classified as stratified flow from the flow map 550 but may be best classified as unclear/stratified/slug flow from the PDF 560. Moreover, point 8 may be best classified as slug flow from the flow map 550 but may be best classified as annular flow from the PDF 560.

Figure 15:
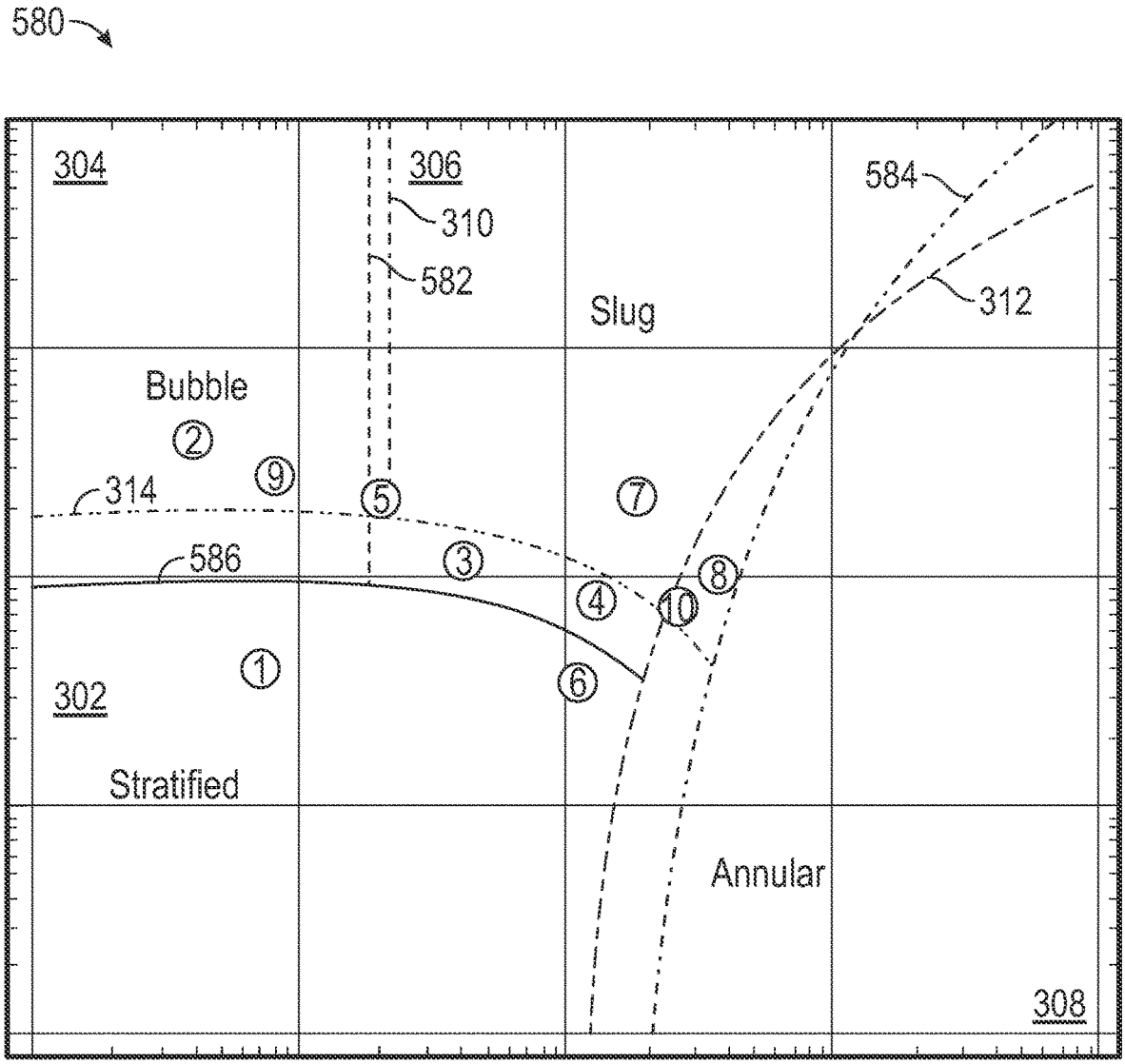
FIG. 15 illustrates the flow map of FIG. 13 showing the multiple data points graphing superficial liquid velocities versus superficial gas velocities but with adjusted transition boundaries, in accordance with embodiments of the present disclosure.

As previously noted, the computing device 254 may adjust the flow map 550 to improve consistency and accommodate blurry transitions. FIG. 15 provides a graphical representation of an embodiment of a flow map 580 that is an adjusted form of the flow map 550. For instance, in the flow map 580, the transition boundary 310 is adjusted to boundary transition 582, the transition boundary 312 is adjusted to boundary transition 584, and the transition boundary 314 is adjusted to boundary transition 586. This adjustment improves consistency and/or better accommodates real world conditions. Table 2 compares self-consistency between the flow map classifications and the PDF classifications before and after adjustment.

Summary of self-consistency before and after adjustment to flow map.

| Data point | Flow regime flow map 550 | Consistent with PDF 560? | Flow regime flow map 580 | Consistent with PDF 560? |
|---|---|---|---|---|
| 1 | Stratified | Yes | Stratified | Yes |
| 2 | Bubble | Yes | Bubble | Yes |
| 3 | Stratified | No | Slug | Yes |
| 4 | Stratified | Yes | Slug | Yes |
| 5 | Bubble | No | Slug | Yes |
| 6 | Stratified | Unclear | Stratified | Yes |
| 7 | Slug | Yes | Slug | Yes |
| 8 | Slug | No | Annular | Yes |
| 9 | Bubble | Yes | Bubble | Yes |
| 10 | Slug | Yes | Annular | Yes |

As illustrated in Table 2, adjusting the transition boundaries of the flow map 580 accommodates the blurry nature of transition boundaries. Furthermore, using the flow map 580 and the PDF 560 increases self-consistency in operation and increases confidence that flow regimes are properly identified thereby increasing the likelihood of proper function in controlling an operation (e.g., production, clean-up, etc.) in the wellbore 16.

Although the foregoing discusses particular processes with blocks shown in a particular order, in some embodiments, the number and/or order of blocks may be changed. Furthermore, although a single computing device 254 is discussed as performing the various tasks of the processes herein, the tasks may be distributed among multiple computing devices 254. For instance, at least some of the tasks may utilize distributed/cloud computing and may be performed using more than one processor 256 and/or computing device 254.

The techniques presented and claimed herein are referenced and applied to material objects and concrete examples of a practical nature that demonstrably improve the present technical field and, as such, are not abstract, intangible, or purely theoretical. Moreover, although various actions are discussed as part of processes in a specific order, at least some of the actions may be performed in different orders. Additionally, at least some of the actions may be performed by one or more processors 256 of suitable computing devices. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method, comprising:

receiving, at one or more processors, measured data corresponding to a wellbore;

locating, using the one or more processors, the measured data in a flow map corresponding to the wellbore;

converting, using the one or more processors, the measured data to determine friction loss;

comparing, using the one or more processors, the located measured data and the determined friction loss;

determining, using the one or more processors, that the located measured data is consistent with the determined friction loss with a common flow regime;

deeming, using the one or more processors, the common flow regime as a current flow regime; and using the one or more processors to control an operation in the wellbore based at least in part on the deemed current flow regime, wherein the operation comprises a production operation or a clean-out operation for the wellbore.

2. The method of claim 1, comprising selecting the flow map from a plurality of flow maps.

3. The method of claim 2, wherein selecting the flow map comprises receiving a user selection of the flow map.

4. The method of claim 1, wherein locating the measured data in the flow map comprises determining a first classification as a first flow regime of a plurality of flow regimes from the location in the flow map.

5. The method of claim 4, wherein locating the measured data in the flow map comprises determining a second classification as a second flow regime of the plurality of flow regimes from the determined friction loss.

6. The method of claim 5, wherein the determined friction loss comprises a probability density function for the determined friction loss and the plurality of flow regimes.

7. The method of claim 1, comprising receiving additional measured data that comprises a plurality of data points.

8. The method of claim 7, wherein at least one of the plurality of data points is not consistently classified between the flow map and the determined friction loss.

9. The method of claim 8, comprising adjusting at least one transition boundary of the flow map based at least in part on the at least one of the plurality of data points being inconsistently classified between the flow map and the determined friction loss.

10. The method of claim 9, wherein adjusting the at least one transition boundary comprises receiving manual adjustment of the at least one transition boundary until the at least one of the plurality of data points is the same flow regime in the flow map as indicated by the determined friction loss.

11. The method of claim 9, wherein adjusting the at least one transition boundary comprises performing an optimization process using a plurality of superficial velocities for the flow map to determine an improved curve for the at least one transition boundary.

12. A system, comprising:

one or more memory devices storing instructions; and one or more processors configured to execute the instructions to cause the one or more processors to:

receive measured data corresponding to a wellbore;

locate the measured data in a flow map corresponding to the wellbore to classify a measured flow regime for the measured data using a first classification;

convert the measured data to determine friction loss;

determine a second classification of the measured flow regime from the friction loss;

determine that the first and second classifications are not consistent;

adjust a transition boundary in the flow map based at least in part on the determination that the first and second classifications are not consistent; and control an operation in the wellbore based at least in part on identification of the measured flow regime based on the adjustment of the transition boundary, wherein the operation comprises a production operation or a clean-out operation for the wellbore.

* * * * *